US011848181B2

(12) United States Patent
Ryumin et al.

(10) Patent No.: US 11,848,181 B2
(45) Date of Patent: Dec. 19, 2023

(54) ACQUISITION STRATEGY FOR TOP-DOWN ANALYSIS WITH REDUCED BACKGROUND AND PEAK OVERLAPPING

(71) Applicant: DH TECHNOLOGIES DEVELOPMENT PTE. LTD., Singapore (SG)

(72) Inventors: Pavel Ryumin, Toronto (CA); Takashi Baba, Richmond Hill (CA); Nic G. Bloomfield, Newmarket (CA)

(73) Assignee: DH Technologies Development Pte. Ltd., Singapore (SG)

( * ) Notice: Subject to any disclaimer, the term of this patent is extended or adjusted under 35 U.S.C. 154(b) by 306 days.

(21) Appl. No.: 17/423,934

(22) PCT Filed: Jan. 31, 2020

(86) PCT No.: PCT/IB2020/050795

§ 371 (c)(1),
(2) Date: Jul. 19, 2021

(87) PCT Pub. No.: WO2020/157720

PCT Pub. Date: Aug. 6, 2020

(65) Prior Publication Data

US 2022/0093377 A1 Mar. 24, 2022

Related U.S. Application Data

(60) Provisional application No. 62/799,600, filed on Jan. 31, 2019.

(51) Int. Cl.
*H01J 49/00* (2006.01)
*H01J 49/02* (2006.01)

(52) U.S. Cl.
CPC ..... *H01J 49/0027* (2013.01); *H01J 49/025* (2013.01)

(58) Field of Classification Search
CPC ... H01J 49/0027; H01J 49/025; H01J 49/0036
(Continued)

(56) References Cited

PUBLICATIONS

Hofstadler, et al. ("Selective Ion Filtering by Digital Thresholding: A Method to Unwind Complex ESI-Mass Spectra and Eliminate Signals from Low Molecular Weight Chemical Noise," Analytical Chemistry, vol. 78, No. 2, Jan. 1, 2006, pp. 372-378 (Year: 2006).*
(Continued)

*Primary Examiner* — Michael Maskell
(74) *Attorney, Agent, or Firm* — Kasha Law LLC; John R. Kasha; Kelly L. Kasha

(57) ABSTRACT

Intensity measurements made by electron multiplier and image-charge detectors are proportional to charge state. These intensities are used to separate detected ions into different data sets and create mass spectra from the different data sets. Ion measurements are separated by charge state using (i) a single electron multiplier detector, (ii) a single image-charge detector, or (iii) multiple electron multiplier ADC detectors. Using (i), the intensity of a peak calculated from each measured pulse is compared to predetermined intensity ranges and each peak is stored in a corresponding data set. Using (ii), each measured transient time-domain signal is converted to frequency-domain peaks, the intensity of each frequency-domain peak is compared to predetermined intensity ranges, and each peak is stored in a corresponding data set. Using (iii), each detector is adapted to measure a predetermined intensity range and store calculated peaks from the measured pulses in corresponding data sets.

14 Claims, 24 Drawing Sheets

(58) Field of Classification Search
USPC ..... 250/281, 282
See application file for complete search history.

(56) References Cited

PUBLICATIONS

International Search Report and Written Opinion for PCT/IB2020/050795, dated Jun. 23, 2020.
Steven A. Hofstadler et al. "Selective Ion Filtering by Digital Thresholding: A Method to Unwind Complex ESI-Mass Spectra and Eliminate Signals from Low Molecular Weight Chemical Noise," Analytical Chemistry, vol. 78, No. 2, Jan. 1, 2006, pp. 372-378, XP055679705, US ISSN: 0003-2700.

* cited by examiner

100

300

400

500

600

1300

1500

2000

MCP gain setting: low

MCP gain setting: high

ACQUISITION STRATEGY FOR TOP-DOWN ANALYSIS WITH REDUCED BACKGROUND AND PEAK OVERLAPPING

RELATED APPLICATIONS

This application claims the benefit of U.S. Provisional Patent Application Ser. No. 62/799,600, filed on Jan. 31, 2019, the content of which is incorporated by reference herein in its entirety.

INTRODUCTION

The teachings herein relate to mass spectrometry systems and methods for separating measured ions into two or more mass spectra based on the charge state of the ions. More specifically, ion measurements are separated by charge state (i) based on the intensity of the ion pulses measured by a single electron multiplier detector, (ii) based on the intensity of frequency-domain peaks converted from a transient time-domain signal measured by an image-charge detector, or (iii) by using two or more electron multiplier analog-to-digital conversion (ADC) detectors that measure different intensity ranges.

The systems and methods disclosed herein are also performed in conjunction with a processor, controller, microcontroller, or computer system, such as the computer system of FIG. 1.

Peak Overlapping Problem

In top-down mass spectrometry (MS) protein analysis, for example, overlapping of mass or mass-to-charge (m/z) peaks in a mass spectrum is a significant problem. In this type of analysis, a very wide range of different fragment or product ions are produced, including product ions that have lengths of 1-200 amino acids and have 1-50 different charge states. The product ion peaks are heavily overlapped with each other in a single spectrum. In addition, the overlap can be so extensive that even mass spectrometers with the highest mass resolution (Fourier transform ion cyclotron resonance (FT-ICR) or orbitrap) cannot deconvolve such overlapped peaks. As a result, large product ions are often lost in top-down protein analysis, limiting the sequence coverage of large proteins.

FIG. 2 is an exemplary diagram 200 showing the fragmentation that occurs in top-down MS protein analysis. In FIG. 2, intact protein 210 is fragmented using tandem MS 220. As a result, product ions 230 of proteins fragments or peptides are produced. A mass spectrum is produced for product ions 230.

FIG. 3 is an exemplary plot 300 showing a product ion spectrum from a top-down MS protein analysis that was measured by a tandem mass spectrometer using an m/z resolution of 30,000. Plot 300 shows that almost every product ion peak has some overlap.

FIG. 4 is an exemplary plot 400 showing a product ion spectrum of the same product ions shown in FIG. 3 but measured by a tandem mass spectrometer using an m/z resolution of 70,000. Plot 400 in comparison with plot 300 of FIG. 3 shows that some overlap of product ion peaks is reduced.

FIG. 5 is an exemplary plot 500 showing a product ion spectrum of the same product ions shown in FIG. 3 and FIG. 4 but measured by a tandem mass spectrometer using an m/z resolution of 240,000. Plot 500 in comparison with plot 400 of FIG. 4 shows still less overlap among product ion peaks. However, even at an m/z resolution of 240,000 overlap is still apparent. FIGS. 3-5 show that overlap can be so extensive that it cannot be remedied by resolution alone.

In conventional electron multiplier detectors, the number of primary electrons generated depends on the charge state of the incident ions (highly charged ions generate more primary electrons, hence a more intense electron signal). Chemushevich et al. (1997), Electrospray ionization time-of-flight mass spectrometry, in Richard B. Cole (Ed.), *Electrospray ionization mass spectrometry: fundamentals, instrumentation, and applications*, New York: Wiley, (hereinafter "Chemushevich et al.") used this property of electron multiplier detectors to separate ions based on charge state and reduce overlap of ion peaks. Specifically, Chernushevich et al. measured ions simultaneously with two time-to-digital conversion (TDC) detectors that used two different constant fraction discriminator (CFD) values. A CFD is a device that finds the maximum of a signal. In this case, the two TDCs were triggered by their CFD devices at different maximum levels of ion intensity. In this way, a first TDC measured all ions above a first maximum level of intensity and charge state and a second TDC measured ions with intensities and charge states above a second higher maximum level. Ions with intensities and charge states in the range between the first maximum level and second higher maximum level could be found by subtracting ions measure by the second TDC from the ions measured by the first TDC.

Although Chemushevich et al. provided an important new method of separating ions, the use of multiple TDC detectors is not ideal. TDC detectors do not measure intensities of ion signals and, therefore, charge states directly. Also, each TDC detector requires a CFD device to limit intensities measured by the TDC detector. As a result, the use of multiple TDC detectors requires additional processing and hardware to find ranges of intensities and charge states.

Consequently, additional systems and methods are needed to separate ions by charge state in order to reduce the overlap between ion peaks measured by mass spectrometry.

Mass Spectrometry Background

Mass spectrometry (MS) is an analytical technique for the detection and quantitation of chemical compounds based on the analysis of m/z values of ions formed from those compounds. MS involves ionization of one or more compounds of interest from a sample, producing precursor ions, and mass analysis of the precursor ions.

Tandem mass spectrometry or mass spectrometry/mass spectrometry (MS/MS) involves ionization of one or more compounds of interest from a sample, selection of one or more precursor ions of the one or more compounds, fragmentation of the one or more precursor ions into product ions, and mass analysis of the product ions.

Both MS and MS/MS can provide qualitative and quantitative information. The measured precursor or product ion spectrum can be used to identify a molecule of interest. The intensities of precursor ions and product ions can also be used to quantitate the amount of the compound present in a sample.

Fragmentation Techniques Background

Electron-based dissociation (ExD), ultraviolet photodissociation (UVPD), infrared photodissociation (IRMPD) and collision-induced dissociation (CID) are often used as fragmentation techniques for tandem mass spectrometry (MS/MS). ExD can include, but is not limited to, electron capture dissociation (ECD) or electron transfer dissociation (ETD). CID is the most conventional technique for dissociation in tandem mass spectrometers.

As described above, in top-down and middle-down proteomics, an intact or digested protein is ionized and subjected to tandem mass spectrometry. ECD, for example, is a dissociation technique that dissociates peptide and protein backbones preferentially. As a result, this technique is an ideal tool to analyze peptide or protein sequences using a top-down and middle-down proteomics approach.

SUMMARY

A system, method, and computer program product are disclosed for separating ions measured by a mass analyzer into two or more mass spectra based on charge state using a single electron multiplier ADC detector, in accordance with various embodiments.

A mass analyzer of a mass spectrometer is instructed to detect a pulse for each ion impacting an electron multiplier ADC detector of the mass analyzer using a processor. Each ion impacting the ADC detector is from a plurality of ions that are transmitted to the mass analyzer by the mass spectrometer. The ADC detector produces detection pulses for detected ions with intensities that are proportional to the ion charge state.

A peak is calculated for each pulse detected using peak finding using the processor. An intensity is calculated for each peak using the processor. The intensity of each peak is compared to two or more different predetermined intensity ranges corresponding to two or more different charge state ranges using the processor. In addition, each peak is stored in one of two or more data sets corresponding to the two or more predetermined intensity ranges based on the comparison using the processor.

A mass spectrum is created for each of the two or more data sets by combining peaks in each data set using the processor. As a result, two or more mass spectra are produced for ions detected by the mass analyzer based on charge state.

A system, method, and computer program product are disclosed for separating ions measured by a mass analyzer into two or more mass spectra based on charge state using an image-charge detector, in accordance with various embodiments.

A mass analyzer of a mass spectrometer is instructed to detect a transient time-domain signal induced on an image-charge detector of the mass analyzer by oscillations of a plurality of ions in the mass analyzer using a processor. The plurality of ions is transmitted to the mass analyzer by the mass spectrometer.

The transient time-domain signal is converted to a plurality of frequency-domain peaks using the processor. Each frequency-domain peak corresponds to an ion of the plurality of ions.

An intensity of each frequency-domain peak of the plurality of frequency-domain peaks is compared to two or more different predetermined intensity ranges corresponding to two or more different charge state ranges using the processor. In addition, each frequency-domain peak is stored in one of two or more data sets corresponding to the two or more predetermined intensity ranges based on the comparison using the processor.

A mass spectrum is created for each of the two or more data sets by combining frequency-domain peaks in each data set, and the combined frequency-domain peaks in each data set are converted to m/z peaks using the processor. Two or more mass spectra are produced for ions detected by the mass analyzer based on charge state.

A system, method, and computer program product are disclosed for separating ions measured by a mass analyzer into two or more mass spectra based on charge state using multiple electron multiplier ADC detectors, in accordance with various embodiments.

A mass analyzer of a mass spectrometer is instructed to simultaneously detect pulses and calculate peaks using each of two or more ADC detectors of the mass analyzer as ions from a plurality of ions in the mass analyzer impact the two or more ADC detectors using a processor. The plurality of ions is transmitted to the mass analyzer by the mass spectrometer. Each detector of the two or more ADC detectors is adapted to use peak finding to calculate peaks from the detection pulses that are within a different ion intensity range of two or more predetermined intensity ranges. The two or more predetermined intensity ranges correspond to two or more different charge state ranges.

Each peak of each detector is stored in a data set corresponding to the detector, producing two or more data sets corresponding to the two or more different charge states.

A mass spectrum is created for each of the two or more data sets by combining peaks in each data set using the processor, producing two or more mass spectra for ions detected by the mass analyzer based on charge state.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
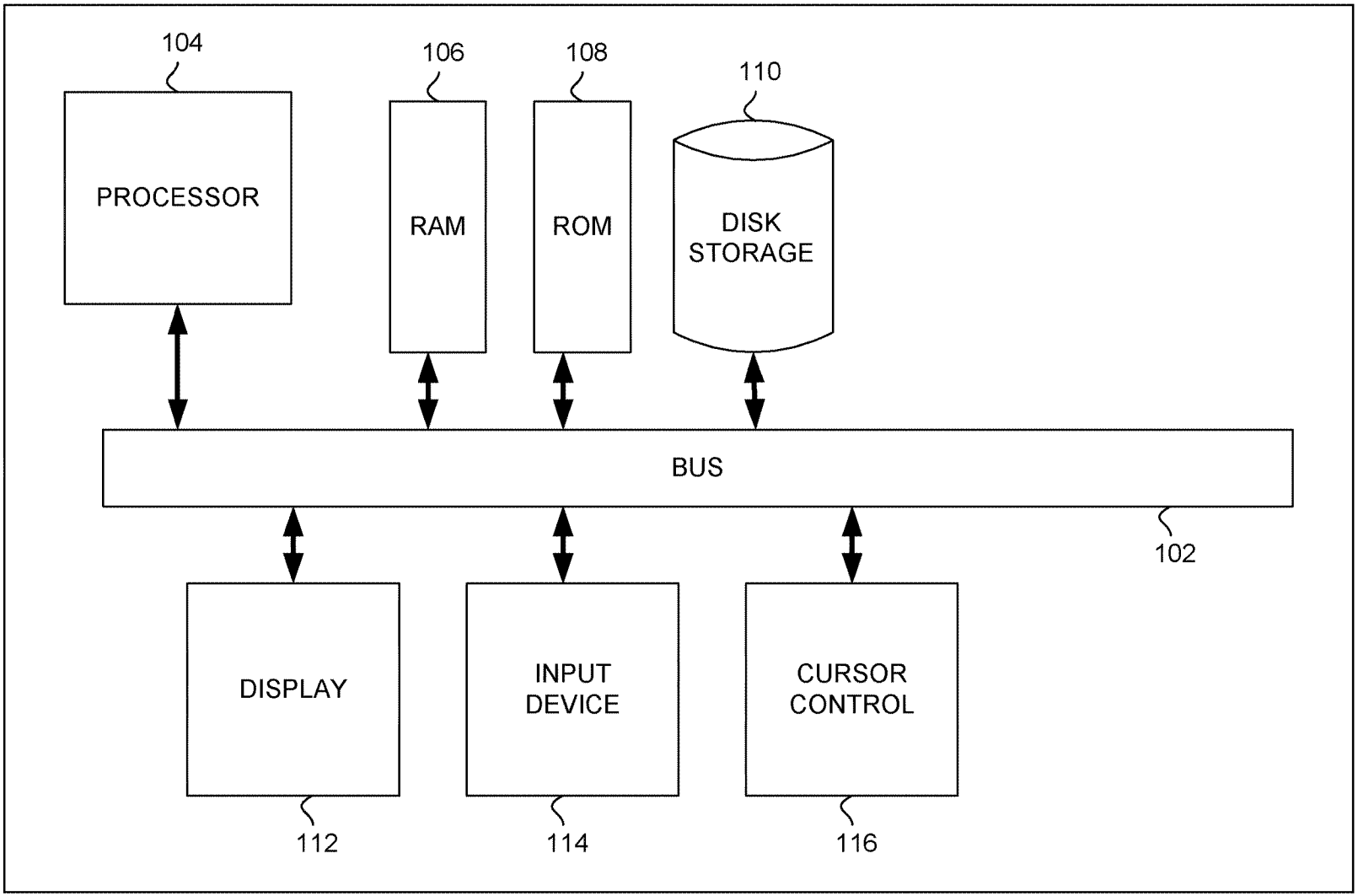
FIG. 1 is a block diagram that illustrates a computer system, upon which embodiments of the present teachings may be implemented.
Figure 2:
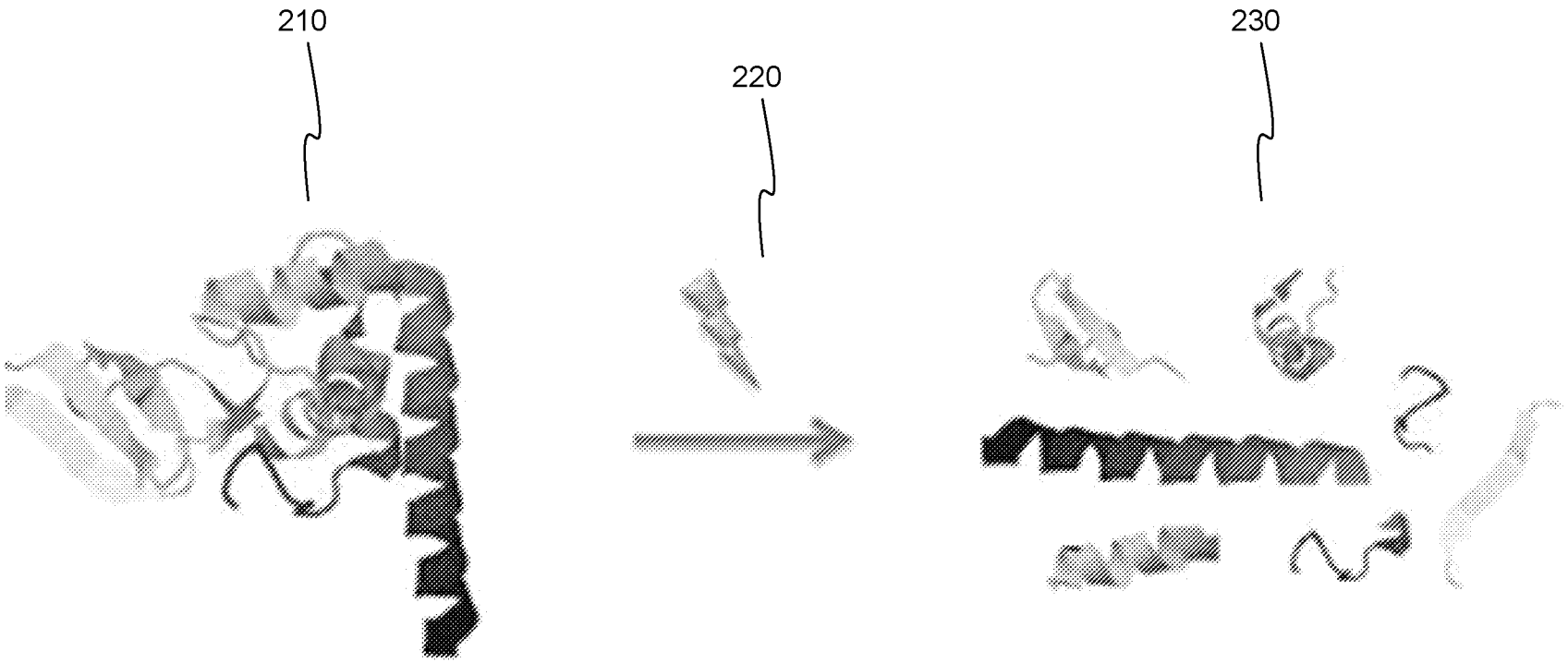
(PRIOR ART) FIG. 2
FIG. 2 is an exemplary diagram showing the fragmentation that occurs in top-down MS protein analysis.
Figure 3:
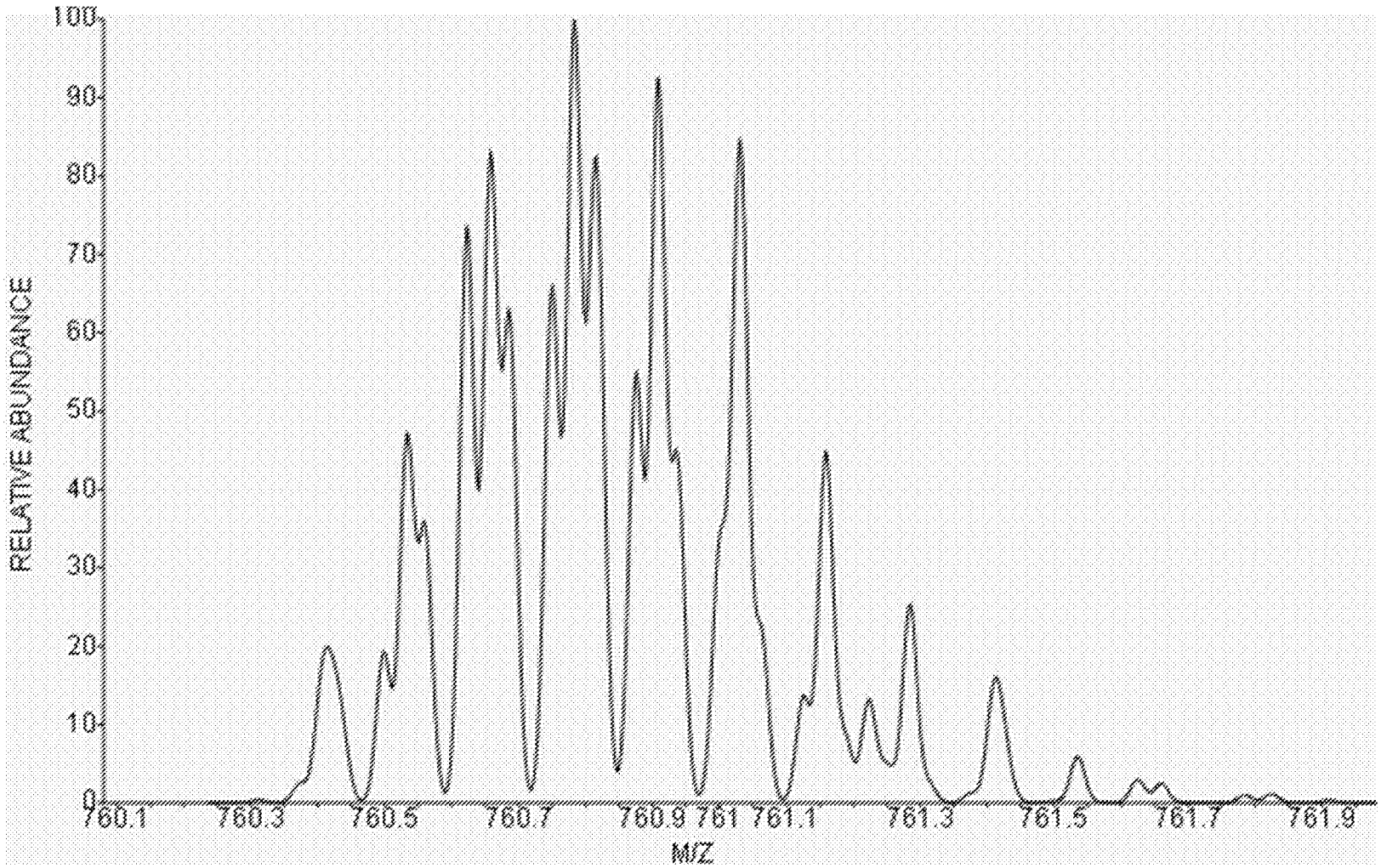
(PRIOR ART) FIG. 3
FIG. 3 is an exemplary plot showing a product ion spectrum from a top-down MS protein analysis that was measured by a tandem mass spectrometer using an m/z resolution of 30,000.
Figure 4:
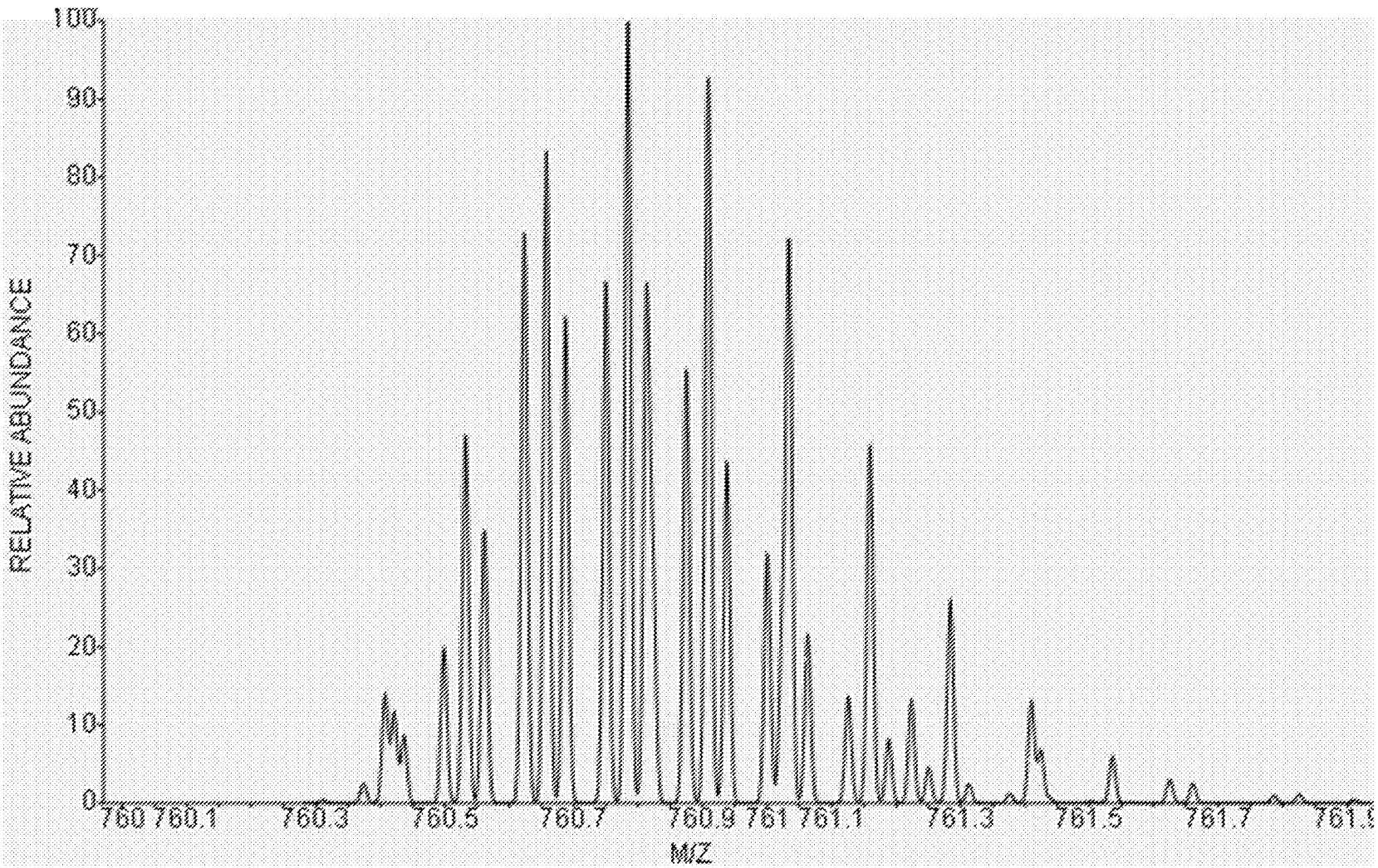
(PRIOR ART) FIG. 4
FIG. 4 is an exemplary plot showing a product ion spectrum of the same product ions shown in FIG. 3 but measured by a tandem mass spectrometer using an m/z resolution of 70,000.
Figure 5:
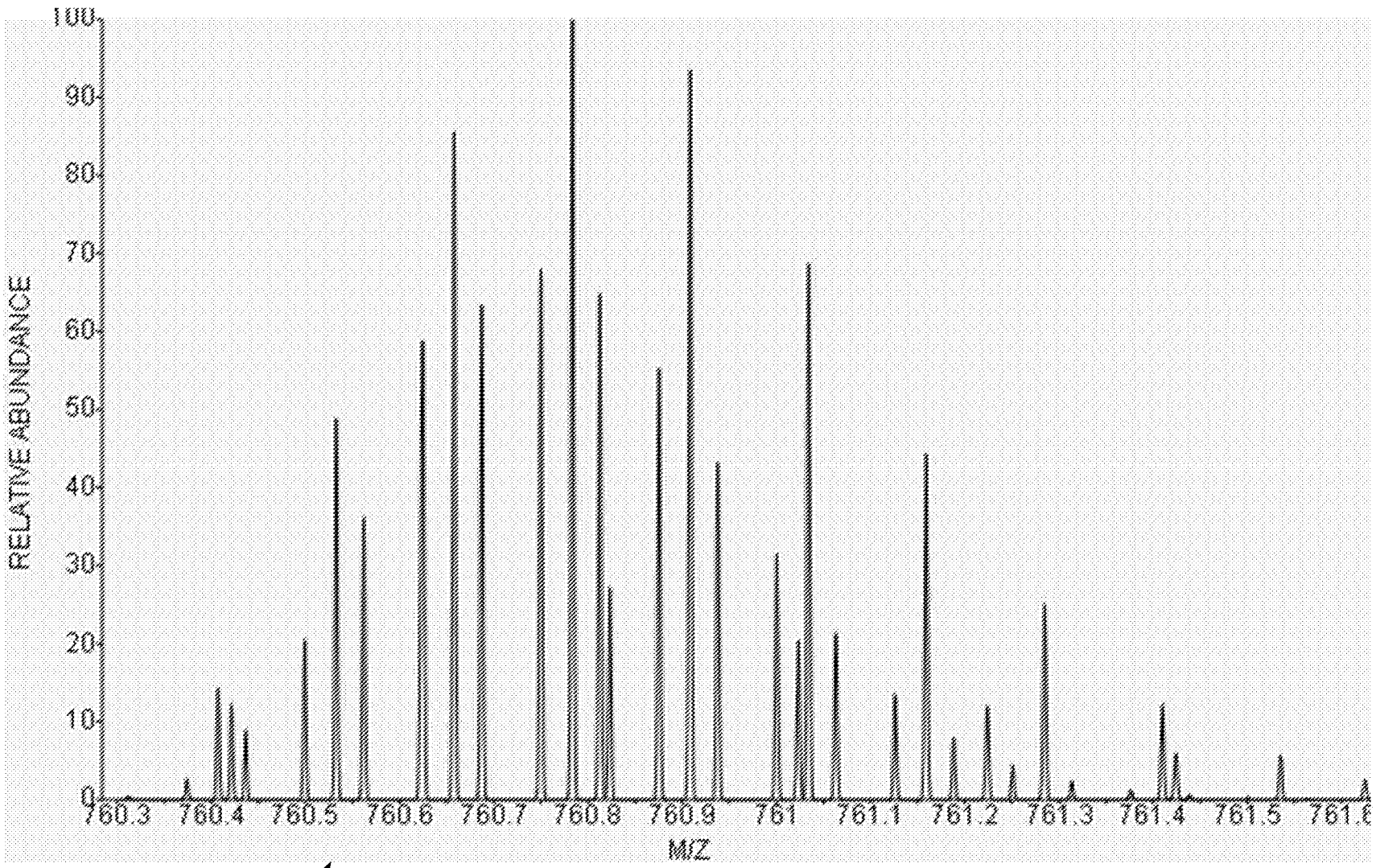
(PRIOR ART) FIG. 5
FIG. 5 is an exemplary plot showing a product ion spectrum of the same product ions shown in FIG. 3 and FIG. 4 but measured by a tandem mass spectrometer using an m/z resolution of 240,000.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read-only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively, hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer-readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software, but the present teachings may be implemented as a combination of hardware and software or in hardware alone. The present teachings may be implemented with both object-oriented and non-object-oriented programming systems.

Peak Separation by Charge State

As described above, in some mass spectrometry analysis methods, such as top-down protein analysis, overlapping of mass or m/z peaks in a mass spectrum is a significant problem. In addition, the overlap can be so extensive that even mass spectrometers with the highest mass resolution cannot deconvolve such overlapped peaks.

In conventional electron multiplier detectors, the number of primary electrons generated depends on the charge state of the incident ions. Chemushevich et al. used this property of electron multiplier detectors to separate ions based on charge state and reduce overlap of ion peaks. Specifically, Chemushevich et al. measured ions simultaneously with two TDC detectors that used two different CFD values. Although Chemushevich et al. provided an important new method of separating ions, the use of multiple TDC detectors is not ideal.

Consequently, additional systems and methods are needed to separate ions by charge state in order to reduce the overlap between ion peaks measured by mass spectrometry.

Single ADC Detector Ion Separation

In various embodiments, ions are measured and then separated according to charge state using a single analog-to-digital converter (ADC) detector. As described above, the number of primary electrons generated in a conventional electron multiplier ADC detector depends on the charge state of the incident ions. Therefore, highly charged ions generate more primary electrons resulting in a more intense electron signal digitized by the ADC detector. This results in substantially different responses for individual ions having different charge states.

It is, therefore, possible to sort the signals during or after acquisition based on their detector signal response. Specifically, ions with different charge states are separated or sorted into different spectra.

One caveat to this method of sorting measured ion signals is that it is dependent upon single ion arrivals at the ADC detector. In other words, if multiple ions arrive at the ADC detector at the same time, the measured intensity may not be proportional to the charge state. As a result, in various embodiments, as described below, additional systems and methods are used to limit or prevent multiple ions from arriving at the ADC detector at the same time.

Figure 6:
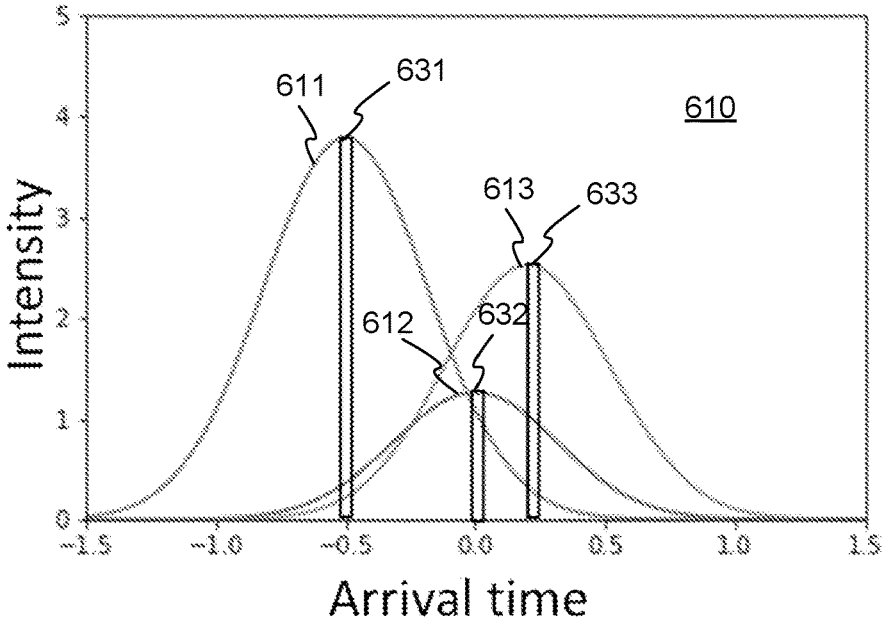
(PRIOR ART) FIG. 6
FIG. 6 is a series of exemplary plots showing how ion signals that are measured by an ADC detector of a time-of-flight (TOF) mass analyzer and have different intensities are conventionally processed.
Figure 6:
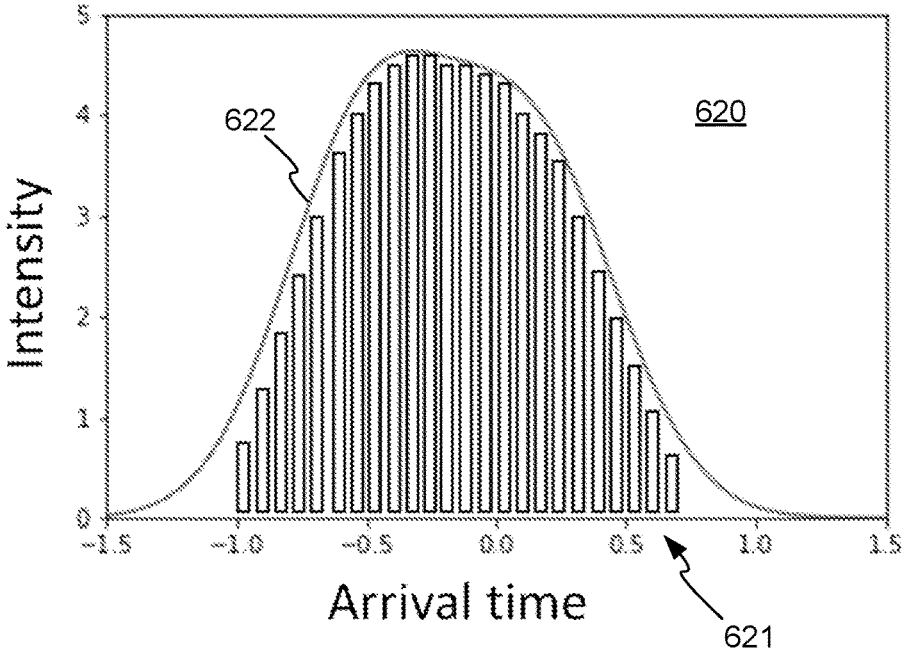
(PRIOR ART) FIG. 6

FIG. 6 is a series 600 of exemplary plots showing how ion signals that are measured by an ADC detector of a time-of-flight (TOF) mass analyzer and that have different intensities are conventionally processed. Plot 610 shows three different analog pulses 611, 612, and 613 of three different single ion arrivals at an ADC detector. Pulses 611, 612, and 613 represent three different ions with different charge states. Traditionally, pulses 611, 612, and 613 are digitized, a peak is found from each digitized pulse, and an intensity and arrival time pair is calculated for each peak. Rectangles 631, 632, and 633 represent the intensity and arrival time pair calculated for each digitized peak.

In plot 620, the intensity and arrival time pairs calculated for all the ions impacting the ADC detector are combined into histogram 621. A single mass peak 622 is formed from histogram 621. As a result, plot 620 shows that, through traditional processing, analog pulses 611, 612, and 613 of plot 610 that represent different peaks can be convolved into a single peak.

Figure 7:
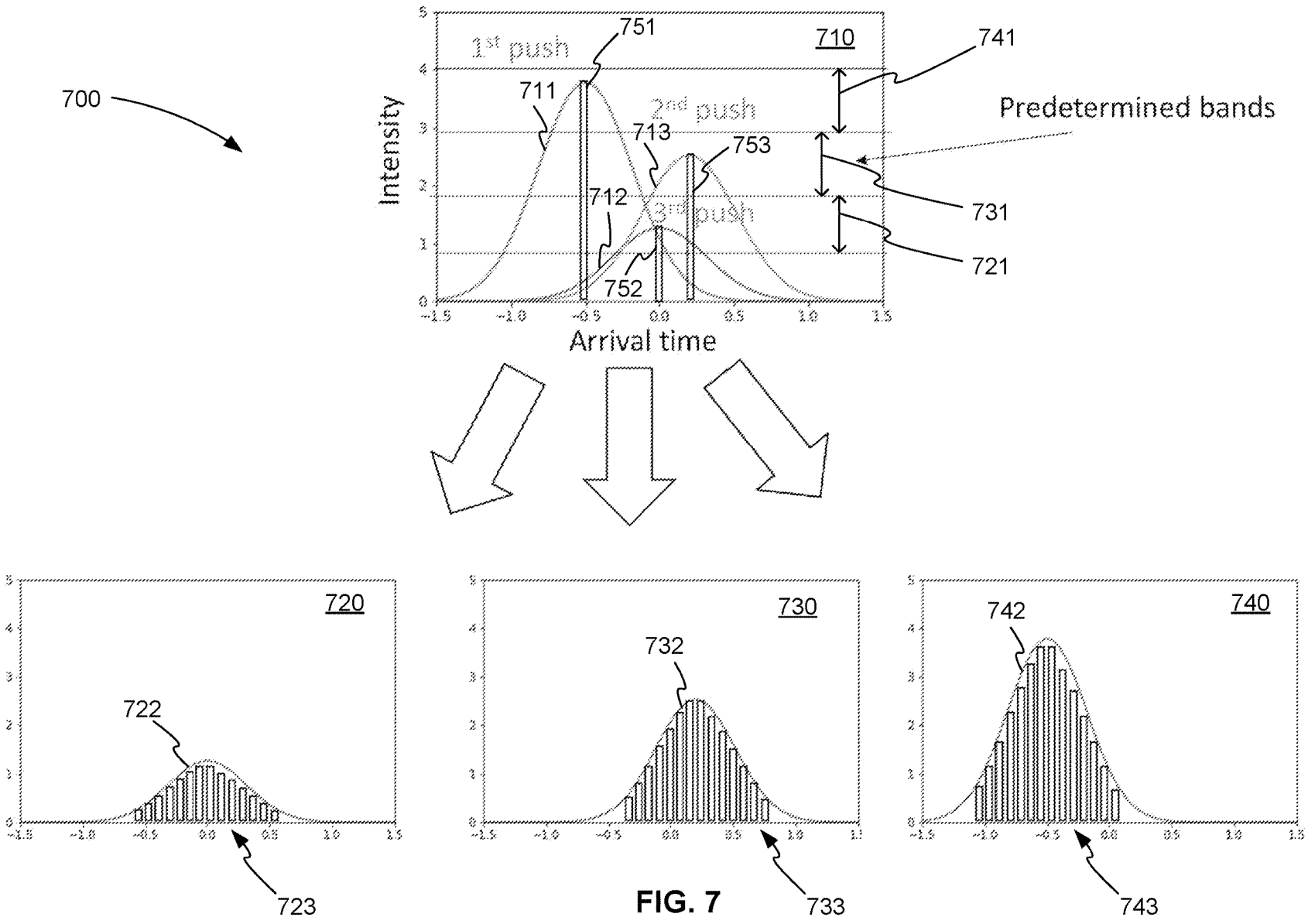
FIG. 7 is a series of exemplary plots showing how ion signals that are measured by an ADC detector of a TOF mass analyzer and have different intensities are processed into separate ion intensity ranges or bands for use in different mass spectra, in accordance with various embodiments.

FIG. 7 is a series 700 of exemplary plots showing how ion signals that are measured by an ADC detector of a TOF mass analyzer and have different intensities are processed into separate ion intensity ranges or bands for use in different mass spectra, in accordance with various embodiments. Like plot 610 of FIG. 6, plot 710 of FIG. 7 shows three different analog pulses 711, 712, and 713 of three different single ion arrivals at an ADC detector. Pulses 711, 712, and 713 represent three different ions with different charge states. As in FIG. 6, pulses 711, 712, and 713 in FIG. 7 are digitized, a peak is found from each digitized pulse, and an intensity and arrival time pair is calculated for each peak. Rectangles 751, 752, and 753 represent the intensity and arrival time pair calculated for each digitized peak.

However, plot 710 further includes at least three predetermined intensity ranges 721, 731, and 741. The intensity of each calculated intensity pair of each ion impacting the ADC detector is compared to ranges 721, 731, and 741. Based on this comparison, each digitized peak is sent to one of three data streams corresponding to ranges 721, 731, and 741. Digitized peaks in each data stream are combined producing spectra 720, 730, and 740 corresponding to ranges 721, 731, and 741, respectively.

The intensity and arrival time pairs calculated for all the ions with peaks in range 721 of plot 710 are combined into histogram 723 of plot 720. A single mass peak 722 is formed from histogram 723 in plot 720.

Similarly, the intensity and arrival time pairs calculated for all the ions with peaks in range 731 of plot 710 are combined into histogram 733 of plot 730. A single mass peak 732 is formed from histogram 733 in plot 730.

Also, the intensity and arrival time pairs calculated for all the ions with peaks in range 741 of plot 710 are combined into histogram 743 of plot 740. A single mass peak 742 is formed from histogram 743 in plot 740.

By separating single ion arrival pulses into the data sets represented by plots 720, 730, and 740, ions with different charge states are separated into different mass spectra. Within each of the different mass spectra, ion peak overlap is reduced.

Figure 8:
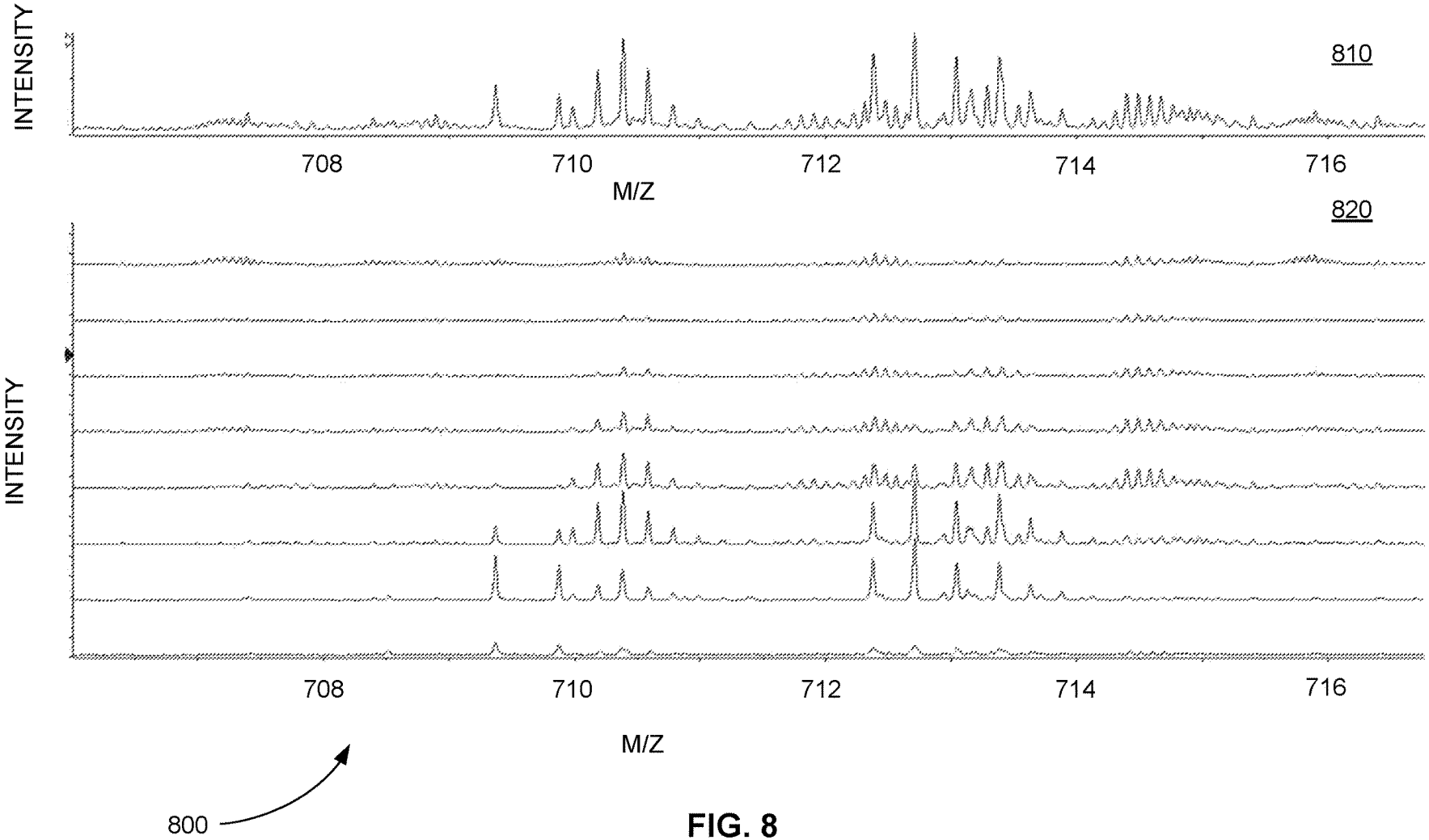
FIG. 8 is a series of plots showing how ion peak overlap is reduced in mass spectra by separating single ion arrival pulses with similar intensities into separate data sets and creating a mass spectrum for each of the separate data sets, in accordance with various embodiments.

FIG. 8 is a series of plots 800 showing how ion peak overlap is reduced in mass spectra by separating single ion arrival pulses with similar intensities into separate data sets and creating a mass spectrum for each of the separate data sets, in accordance with various embodiments. Plot 810 of FIG. 8 shows a portion of a mass spectrum where all ion arrival pulses are conventionally combined to generate a single mass spectrum. The mass spectrum of plot 810 includes considerable ion peak overlap.

Plot 820, in contrast, shows eight separate mass spectra all plotted on the same scale and also plotted on the same scale as the mass spectrum of plot 810. Each of the mass spectra of plot 820 represents combined ion peaks for single arrival pulses with similar intensities. In other words, the eight different mass spectra of plot 820 represent ions with eight different charge state ranges. A comparison of the eight different mass spectra in plot 820 shows that a large amount of ion peak overlap is reduced by separating the ions into these different mass spectra. Note that many peaks in the eight different mass spectra in plot 820 that have the same m/z value.

Hofstadler et al., selective ion filtering by digital thresholding: a method to unwind complex ESI-mass spectra and eliminate signals from low molecular weight chemical noise, Anal. Chem 2006, 78, 372-378, (hereinafter the "Hofstadler Paper") has described a previous method of separating ions with different charge states. This method uses electronics in the time-of-flight (TOF) mass analyzer that allow the user to set a cutoff voltage. The cutoff voltage essentially zeros out signals below a "digital threshold." In other words, low-bit ADC counts or points are discarded.

In the Hofstadler Paper, for example, the digital threshold is set above the intensity of singly charged ions but below the intensity of their multiply charged counterparts. As a result, only the multiply charged ions are detected and these ions are effectively separated from their singly charged counterparts. The use of a single digital threshold, however, does not allow the singly charged ions to be separated from the multiply charged ions.

In order to separate ions with lower charge states from ions with higher charge states, the Hofstadler Paper proposes using more than one digital threshold and then subtracting ions detected at a higher threshold from ions detected at a lower threshold. Specifically, the Hofstadler Paper describes a method "in which output from the ADC is split to multiple parallel data streams, each of which is subjected to a different digital threshold. By subtracting spectra acquired at different digital thresholds," a mass spectrum is obtained for any "slice" of the ion population.

The method of the Hofstadler Paper has at least two problems, however. First of all, the discarding of low-bit ADC counts or points can lead to the incorrect assignment of the time-of-flight of an ion. In other words, the loss of points across the peak can result in the wrong peak position.

Figure 9:
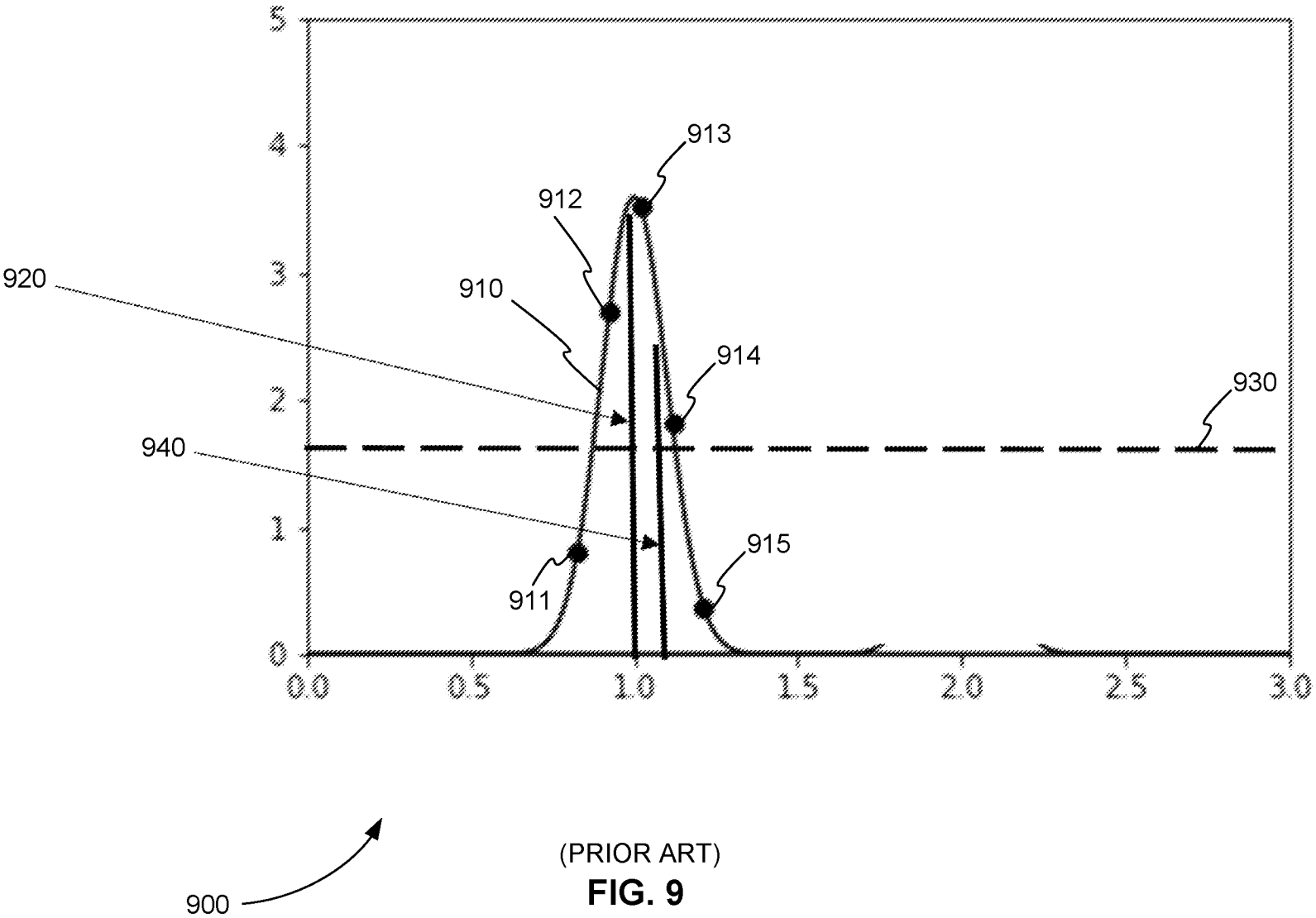
(PRIOR ART) FIG. 9
FIG. 9 is an exemplary plot showing how the discarding of low-bit ADC points of a pulse can produce an incorrect peak position as a result of the digital threshold used in the method of the Hofstadler Paper.

FIG. 9 is an exemplary plot 900 showing how the discarding of low-bit ADC points of a pulse can produce an incorrect peak position as a result of the digital threshold used in the method of the Hofstadler Paper. Plot 900 shows points or counts 911, 912, 913, 914, and 915 of an ion pulse 910 that an ADC detector is capable of detecting. The true peak position of ion pulse 910 using points 911, 912, 913, 914, and 915 is shown by line 920.

However, in the method of the Hofstadler Paper, the number of points used to determine the peak position is reduced. For example, if a digital threshold 930 is used, points 911 and 915 are discarded. As a result, the peak position is determined only from points 912, 913, and 914. Using these points, the peak position of ion pulse 910 is now shown by line 940. A comparison of lines 920 and 940 shows that the method of the Hofstadler Paper can sometimes lead to an incorrect peak position.

A second problem with the method of the Hofstadler Paper results from the subtraction of spectra used to separate ions with lower charge states from ions with higher charge states. Specifically, the subtraction of spectra can result in artificial or remnant peaks as a result of discarding low bit ADC counts or points.

Figure 10:
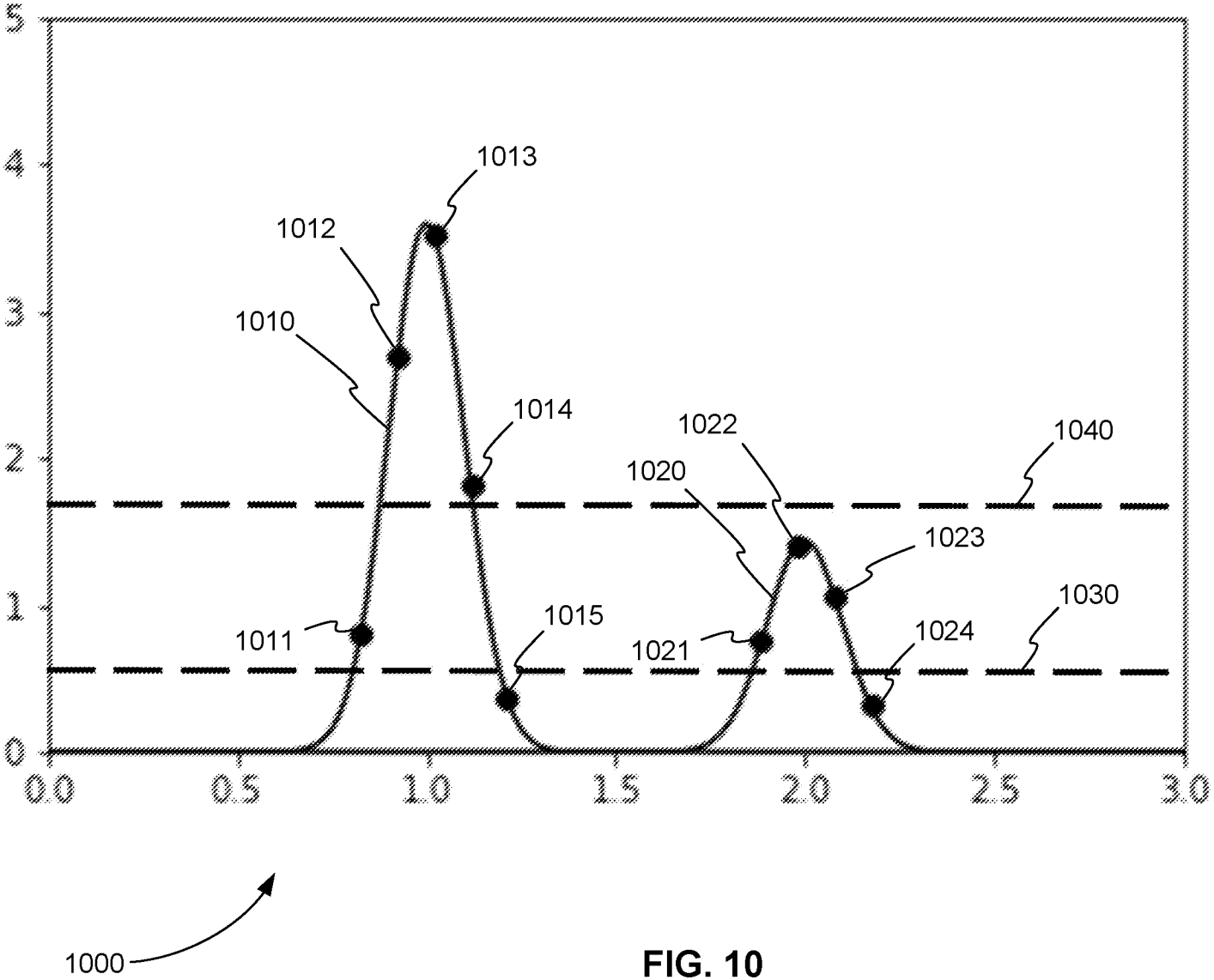
FIG. 10 is an exemplary plot showing how spectra acquired at different digital thresholds are subtracted from one another in the method of the Hofstadler Paper.

FIG. 10 is an exemplary plot 1000 showing how spectra acquired at different digital thresholds are subtracted from one another in the method of the Hofstadler Paper. In order to separate lower charge state peak 1020 from higher charge state peak 1010, for example, the method of the Hofstadler Paper uses two different digital thresholds 1030 and 1040. First, the method of the Hofstadler Paper creates a first spectrum using digital threshold 1030. In other words, all points above digital threshold 1030 are used to create the first spectrum. Point 1015 of peak 1010 and point 1024 of peak 1020 are discarded.

Then, the method of the Hofstadler Paper creates a second spectrum using digital threshold 1040. In other words, all points above digital threshold 1040 are used to create the second spectrum. Points 1011 and 1015 of peak 1010 are discarded and all points of peak 1020 are discarded.

Finally, the second spectrum is subtracted from the first spectrum in order to separate lower charge state peak 1020 from higher charge state peak 1010. In other words, all the points above digital threshold 1040 are subtracted from all the points above digital threshold 1030.

This subtraction scheme works well unless the lower charge state peak and the higher charge state peak share points between the two thresholds. For example, in plot 1000, higher charge state peak 1010 includes point 1011, which is located between digital threshold 1030 and digital threshold 1040. As a result, when the second spectrum is subtracted from the first spectrum, in this case, point 1011 of peak 1010 remains. This results in an artificial or remnant peak.

Figure 11:
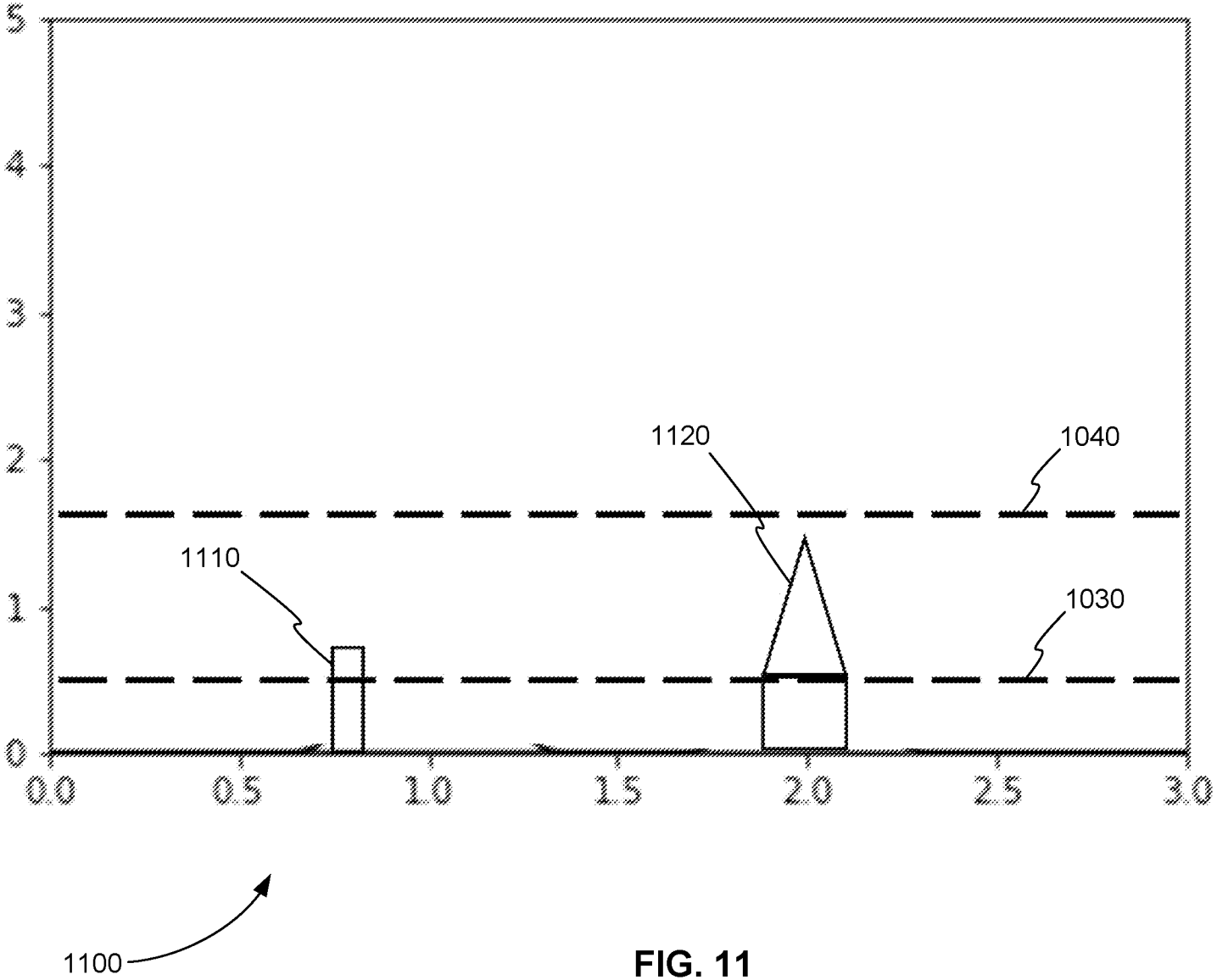
FIG. 11 is an exemplary plot showing that an artificial peak and a lower charge state peak are produced when the different digital thresholds of FIG. 10 are applied to the peaks of FIG. 10 according to the method of the Hofstadler Paper.

FIG. 11 is an exemplary plot 1100 showing that an artificial peak and a lower charge state peak are produced when the different digital thresholds of FIG. 10 are applied to the peaks of FIG. 10 according to the method of the Hofstadler Paper. Plot 1100 shows that artificial or remnant peak 1110 and lower charge state peak 1120 are produced by subtracting all the points above digital threshold 1030 from all the points above digital threshold 1040 in FIG. 10.

Plot 1100 of FIG. 11 shows that the method of the Hofstadler Paper can produce an unwanted remnant peak 1110 of a higher charge state peak when tying to separate a lower charge state peak from that higher charge state peak. This is because the method of the Hofstadler Paper simply discards points below the digital threshold. In other words, the method of the Hofstadler Paper does not completely subtract the higher charge state peak from the lower charge state peak.

Various embodiments described herein provide an improvement over the method of the Hofstadler Paper. As shown above, in FIG. 7, various embodiments include performing peak or pulse detection before determining the range or band of each pulse. This peak finding step ensures that the correct peak position is found before the assignment of points or counts to a specific range. In addition, no artificial or remnant peaks are produced since no subtraction and discarding of low bit ADC counts or points are initially performed.

In contrast, the method of the Hofstadler Paper does not recognize that prior to filtering there is an important step of peak detection. Instead, the method of the Hofstadler Paper instead blindly filters out the low-bit ADC signal.

More specifically, in various embodiments, each detected pulse is digitized using an ADC. After pulse digitization, there is an added step where each digitized pulse is converted to a pulsed time and intensity pair. This conversion is performed using pulse finding, which is more commonly referred to as "peak finding." One of ordinary skill in the art can appreciate that peak finding can be performed using a variety of different methods. One exemplary method includes triggering the ADC to send signals (or points) above a certain threshold including a number of neighboring points. These points are then used to calculate the time and intensity of the peak.

For example, the time of the peak can be the time position of its apex or the time of its inception. Similarly, generally accepted methods of finding peak intensity include, but are not limited to, calculating peak area, peak height, or peak width.

In various embodiments, after the time and intensity pair for each digitized pulse is found using peak finding, band-pass filtering is performed using the intensity of the time and intensity pair. More specifically, the intensity of the time and intensity pair of each digitized pulse is used to determine the predetermined band or intensity range in which the digitized pulse is to be stored. The pulses for each predetermined band or intensity range are then summed to produce the appropriate mass spectrum for the predetermined band or intensity range. As a result, systems and methods in accordance with various embodiments prevent the situation where ADC points from the same pulse are put into different spectra.

In addition, in various embodiments, by defining the peaks of the digitized pulses before assigning them to a band or intensity range, the peaks are not distorted and correct peak position is maintained.

Single ADC Detector Ion Separation System

Figure 12:
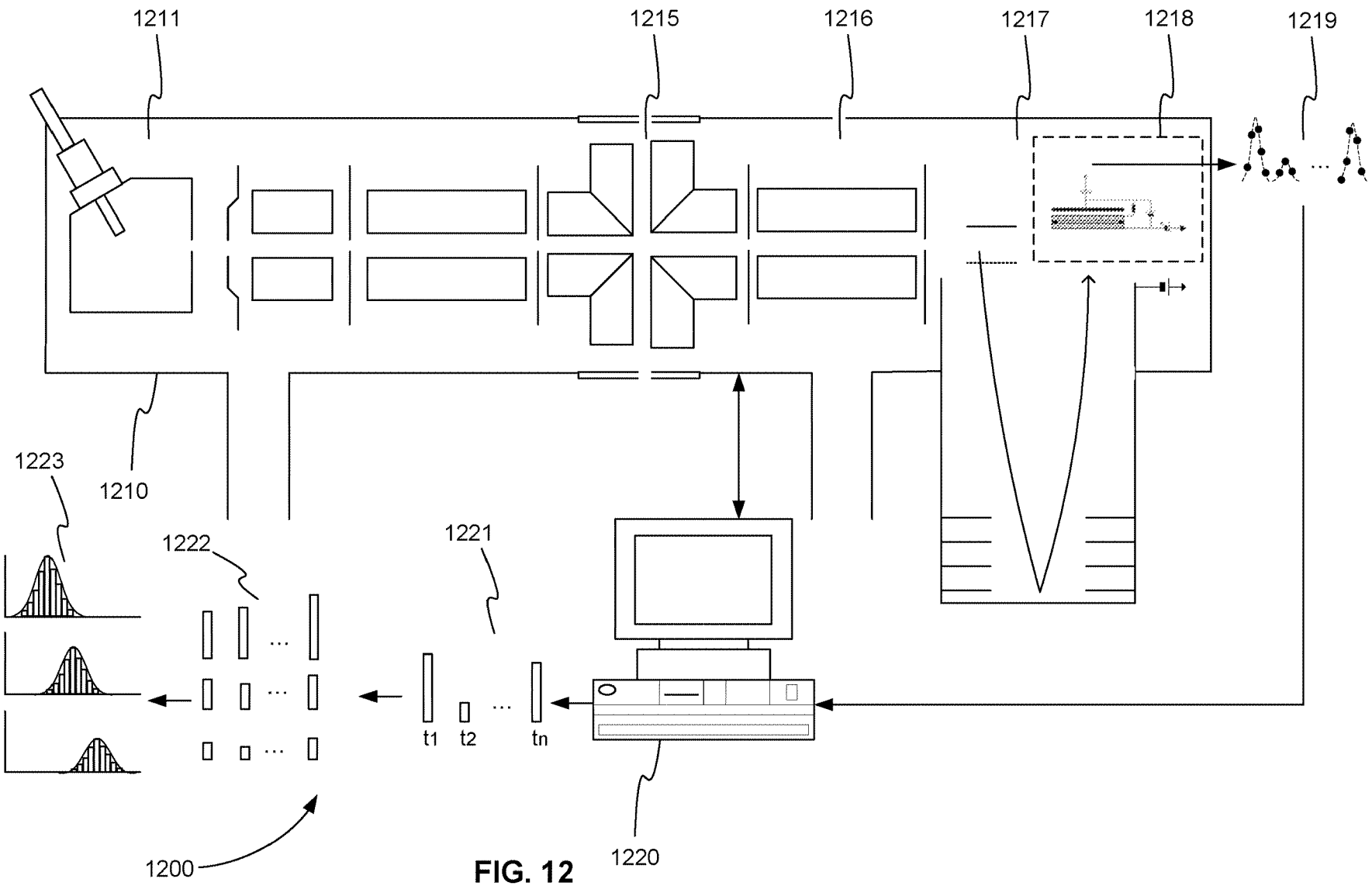
FIG. 12 is an exemplary schematic diagram showing a system for separating ions measured by a mass analyzer into two or more mass spectra based on charge state using a single electron multiplier ADC detector, in accordance with various embodiments.

FIG. 12 is an exemplary schematic diagram 1200 showing a system for separating ions measured by a mass analyzer into two or more mass spectra based on charge state using a single electron multiplier ADC detector, in accordance with various embodiments. The system of FIG. 12 includes mass spectrometer 1210 and processor 1220. Mass spectrometer 1210 includes mass analyzer 1217.

Mass analyzer 1217 includes electron multiplier ADC detector 1218. ADC detector 1218 produces detection pulses for detected ions with intensities that are proportional to ion charge state. Mass analyzer 1217 can be any type of mass analyzer that can detect ions using an ADC detector including, but not limited to, a time-of-flight (TOF), an ion trap, or a quadrupole mass analyzer.

Note that ADC detector 1218 produces detection pulses for detected ions with intensities that are not necessarily linearly proportional to ion charge state. In other words, more specifically, the charge state is equal to a monotonically increasing function of peak intensity that is not necessarily linear.

Processor 1220 instructs mass analyzer 1217 to detect a pulse for each ion impacting ADC detector 1218 from a plurality of ions that are transmitted to mass analyzer 1217 by mass spectrometer 1210. Detected digital pulses 1219 are produced.

Processor 1220 calculates a peak for each pulse detected using peak finding. Peaks 1221 are calculated, for example. As described above, peak finding can be performed using a variety of different methods. One exemplary method includes grouping a pulse or point and a number of neighboring points into a peak shape.

Processor 1220 calculates an intensity for each peak. As described above, generally accepted methods of finding peak intensity include, but are not limited to, calculating peak area, peak height, or peak width.

In various embodiments, processor 1220 further calculates an arrival time for each peak. The intensity of each peak and the arrival time of each peak form an intensity and arrival time pair for each peak. Intensity and arrival time pairs 1221 are produced by processor 1220 for the calculated peaks, for example.

Processor 1220 compares an intensity of each peak to two or more different charge state ranges. Processor 1220 stores each peak in one of two or more data sets corresponding to the two or more predetermined intensity ranges based on the comparison. Two or more data sets are produced, for example. Each peak is stored in one of two or more data sets by storing the peak in a memory device (not shown). The memory device can include a volatile memory device, such as RAM, or a permanent memory, such as a magnetic disk or a solid-state drive (SSD). The two or more data sets can be stored in separate logical locations in the memory device. For example, each of the two or more data sets can be stored in a separate file. In various embodiments, processor 1220 stores intensity and arrival time pairs for each peak in two or more data sets 1222, for example.

The terms "store" and "stored" do not mean to imply that all of the processing cannot occur in real-time or that the steps following any "storing" can only occur post-acquisition. In other words, processor 1220 stores each peak in one of two or more data sets and then creates a mass spectrum for each of the two or more data sets all in real-time.

Finally, processor 1220 creates a mass spectrum for each of two or more data sets by combining peaks in each data set. Two or more mass spectra are, therefore, produced for ions detected by mass analyzer 1217 based on charge state. In various embodiments, combining peaks in each data set of the two or more data sets comprises combining intensity and arrival time pairs of peaks in each data into a histogram and creating the mass spectrum from the histogram. Mass spectra 1223, for example, are created from the histograms. Note that only one mass peak is shown for each spectrum of mass spectra 1223. However, each spectrum can include one or more mass peaks.

In FIG. 12, each peak is stored in one data set. In various embodiments, however, processor 1220 can further store a peak in one or more other data sets of the two or more data sets. For example, a peak can be stored in the data sets of all ranges having a lower threshold that is below the intensity of the peak. Or, alternatively, a peak can be stored and all the data sets of all ranges having an upper threshold that is above the intensity of the peak.

By storing peaks in multiple data sets, additional data sets can be formed by combining these data sets. Combining these data sets can include, but is not limited to, adding or subtracting.

In FIG. 7, for example, ranges 721, 731, and 741 do not overlap. In various alternative embodiments, however, the two or more different predetermined intensity ranges include at least two ranges that are overlapping. Returning to FIG. 12, processor 1220 can then, for example, combine data sets corresponding to the at least two ranges to produce one or more data sets corresponding to one or more non-overlapping intensity ranges. Again, combining these data sets can include, but is not limited to, adding or subtracting.

As described in the Hofstadler Paper, data sets can be subtracted in order to separate ions with different charge states. The method of the Hofstadler Paper, however, can result in artificial or remnant peaks being included in the wrong charge state spectrum. This is due to the method of discarding points in the Hofstadler Paper. This method can result in having different points of the same peak in different data sets.

In various embodiments described herein, all the points of the same peak can be in different data sets. However, different points of the same peak cannot be in different data sets. As a result, various embodiments described herein do not produce artificial or remnant peaks when data sets are combined through subtraction or other methods of combining the data sets. Consequently, various embodiments described herein can combine data sets including peaks with different charge states more advantageously than the method of the Hofstadler Paper.

In various embodiments, processor 1220 compares an intensity of each peak to two or more different charge state ranges and stores each peak in one of two or more data sets during mass spectrometry scans or during acquisition. In an alternative embodiment, processor 1220 compares an intensity of each peak to two or more different predetermined intensity ranges and stores each peak in one of two or more data sets after mass spectrometry scans or after acquisition.

As described above, the measured intensity of a detected pulse is proportional to the charge state only for single ion arrivals at ADC detector 1218. In other words, if multiple ions arrive at ADC detector 1218 at the same time, the measured intensity may not be proportional to the charge state. As a result, in various embodiments, mass spectrometer 1210 transmits ions to mass analyzer 1217 so that ADC detector 1218 only receives a single ion impact at any given time.

In various embodiments, the system of FIG. 12 further includes ion source device 1211. Ion source device 1211 can be an electrospray ion source (ESI) device, for example. Ion source device 1211 is shown as part of mass spectrometer 1210 in FIG. 12 but can be a separate device also.

In addition, mass spectrometer 1210 further includes a dissociation device. The dissociation device can be, but is not limited to, ExD device 1215 or CID device 1216. A dissociation device can be used for top-down protein analysis, for example.

In top-down protein analysis, processor 1220 instructs ion source device 1211 to ionize a protein of a sample, producing a plurality of precursor ions for the protein in an ion beam. Processor 1220 then instructs the dissociation device to dissociate the plurality of precursor ions in the ion beam, producing a plurality of product ions with different charge states in the ion beam.

Processor 1220 instructs mass spectrometer 1210 to transmit the plurality of product ions to mass analyzer 1217 so that the plurality of product ions are the plurality of ions transmitted to mass analyzer 1217 by mass spectrometer 1210 as described above.

In various embodiments, processor 1220 is used to control or provide instructions to ion source device 1211 and mass spectrometer 1210 and to analyze data collected. Processor 1220 controls or provides instructions by, for example, controlling one or more voltage, current, or pressure sources (not shown). Processor 1220 can be a separate device as shown in FIG. 12 or can be a processor or controller of one or more devices of mass spectrometer 1210. Processor 1220 can be, but is not limited to, a controller, a computer, a microprocessor, the computer system of FIG. 1, or any device capable of sending and receiving control signals and data and analyzing data.

In various embodiments, ADC detector 1218 includes a multi-channel digitizer (not shown) and processor 1218 instructs mass analyzer 1217 to detect a pulse for each ion impacting the ADC detector from each digitizer of the multi-channel digitizer.

Currently, some conventional TOF mass analyzers use ion detection systems that include four-channel digitizers, for example. A four-channel digitizer can include either a time-to-digital converter (TDC) or an ADC. Multichannel ion detection systems provide two main benefits: enhanced dynamic range and improved resolution through independent calibration of channels (also known as channel alignment).

Figure 23:
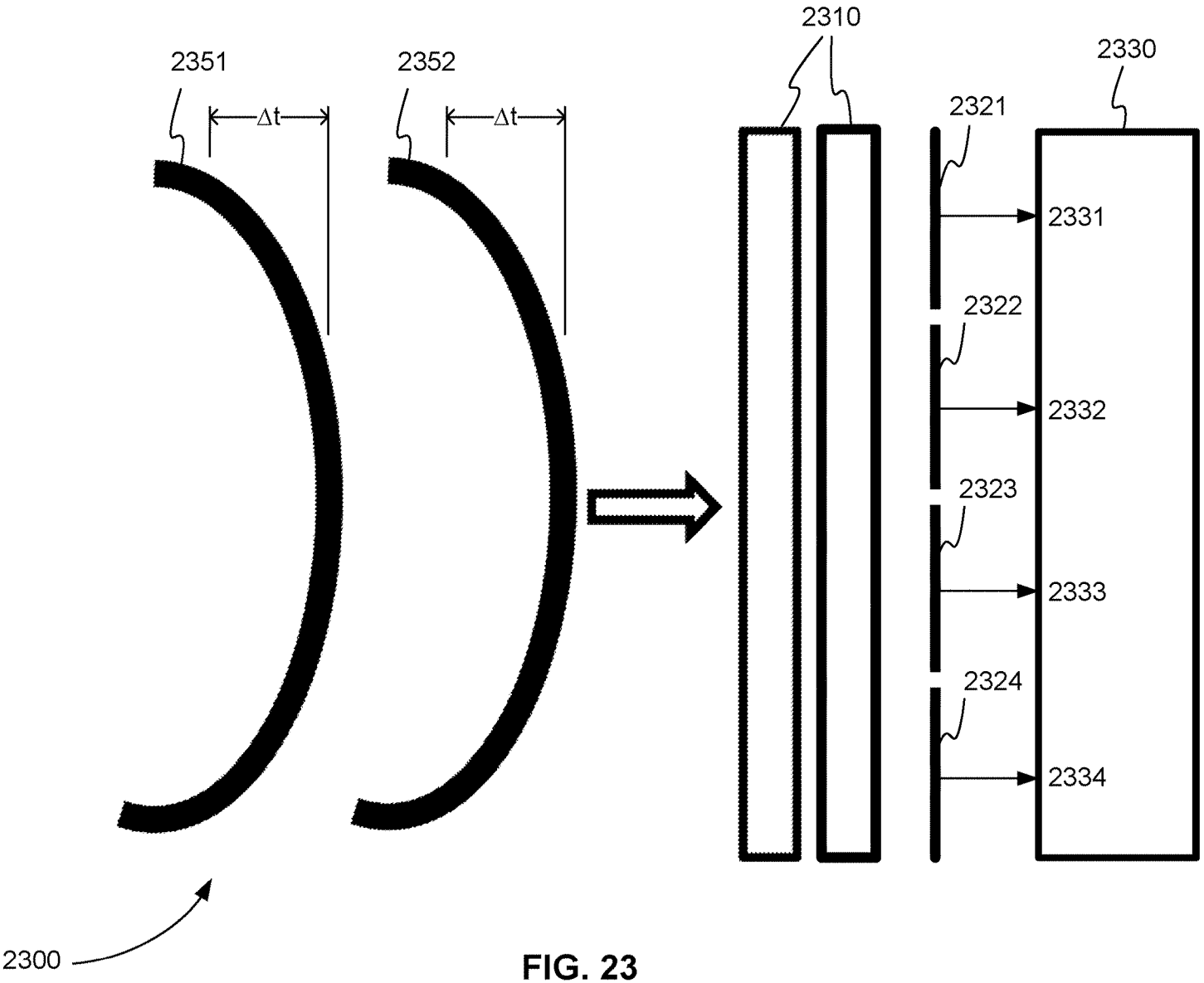
FIG. 23 is a side view of an exemplary TOF ion detection system showing how the digitized signals of exemplary ion packets that each has a non-ideal shape are obtained using four electrodes and a four-channel digitizer to improve resolution, upon which embodiments of the present teachings may be implemented.

FIG. 23 is a side view 2300 of an exemplary TOF ion detection system showing how the digitized signals of exemplary ion packets that each has a non-ideal shape are obtained using four electrodes and a four-channel digitizer to improve resolution, upon which embodiments of the present teachings may be implemented. In FIG. 23, two microchannel plates (MCPs) 2310 positioned in series are impacted by ion packets 2351 and 2352, which have convex shapes. Multiplied electrons produced by MCPs 2310 are collected by four segmented anode electrode plates 2321, 2322, 2323, and 2324. Each of anode electrode plates 2321, 2322, 2323, and 2324 is electrically connected to a separate channel of four-channel digitizer 2330.

Four-channel digitizer 2330 is, for example, an ADC or a TDC. Each of anode electrode plates 2321, 2322, 2323, and 2324 can also be electrically connected to four-channel digitizer 2330 through a four-channel preamplifier (not shown), for example. A four-channel preamplifier amplifies the electrical signal received from the electrode plates.

MCPs 2310 essentially translate an ion impact image on one side to a corresponding electron emission image on the other side. Although ion packets 2351 and 2352 have convex shapes, their images on either side of MCPs 2310 have a rectangular pattern or shape.

Returning to FIG. 12, in various embodiments, each digitizer of a multi-channel digitizer (not shown) of ADC detector 1218 digitizes pulses within the same intensity range.

In various alternative embodiments, each digitizer of the multi-channel digitizer of ADC detector 1218 is adapted to digitize pulses within a different predetermined intensity range of the two or more different predetermined intensity ranges. Each digitizer digitizes pulses within a different predetermined intensity range using a different detector gain or different ADC threshold, for example.

Single ADC Detector Ion Separation Method

Figure 13:
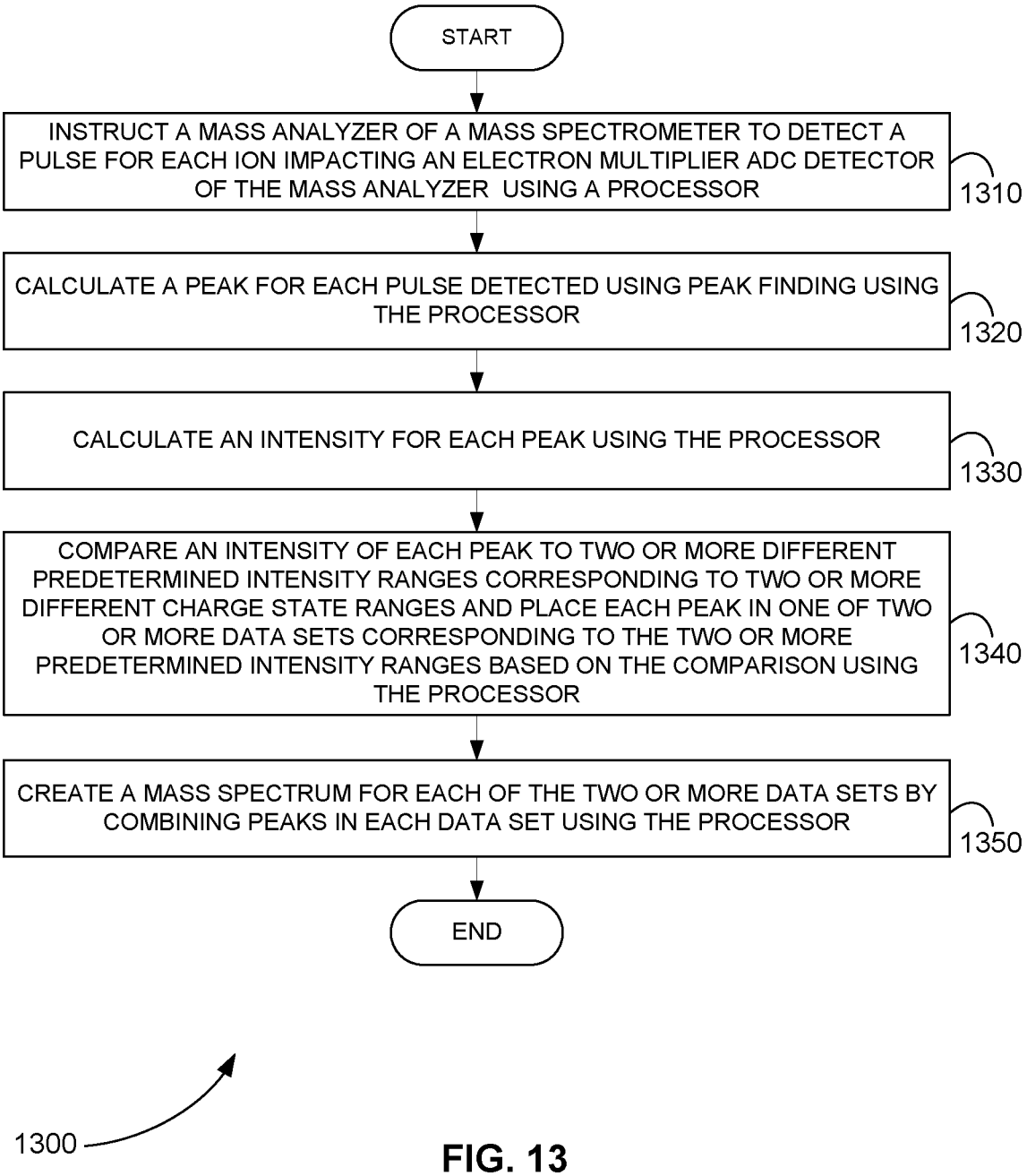
FIG. 13 is a flowchart showing a method for separating ions measured by a mass analyzer into two or more mass spectra based on charge state using a single electron multiplier ADC detector, in accordance with various embodiments.

FIG. 13 is a flowchart showing a method 1300 for separating ions measured by a mass analyzer into two or more mass spectra based on charge state using a single electron multiplier ADC detector, in accordance with various embodiments.

In step 1313 of method 1300, a mass analyzer of a mass spectrometer is instructed to detect a pulse for each ion impacting an electron multiplier ADC detector of the mass analyzer using a processor. Each ion impacting the ADC detector is from a plurality of ions that are transmitted to the mass analyzer by the mass spectrometer. The ADC detector produces detection pulses for detected ions with intensities that are proportional to the ion charge state.

In step 1320, a peak is calculated for each pulse detected using peak finding using the processor.

In step 1330, calculate an intensity for each peak using the processor.

In step 1340, an intensity of the time and intensity pair of each peak is compared to two or more different predetermined intensity ranges corresponding to two or more different charge state ranges using the processor. In addition, each peak is stored in one of two or more data sets corresponding to the two or more predetermined intensity ranges based on the comparison using the processor.

In step 1350, a mass spectrum is created for each of the two or more data sets by combining peaks in each data set using the processor. As a result, two or more mass spectra are produced for ions detected by the mass analyzer based on charge state.

Single ADC Detector Ion Separation Computer Program Product

In various embodiments, computer program products include a tangible computer-readable storage medium whose contents include a program with instructions being executed on a processor so as to perform a method for separating ions measured by a mass analyzer into two or more mass spectra based on charge state using a single electron multiplier ADC detector. This method is performed by a system that includes one or more distinct software modules.

Figure 14:
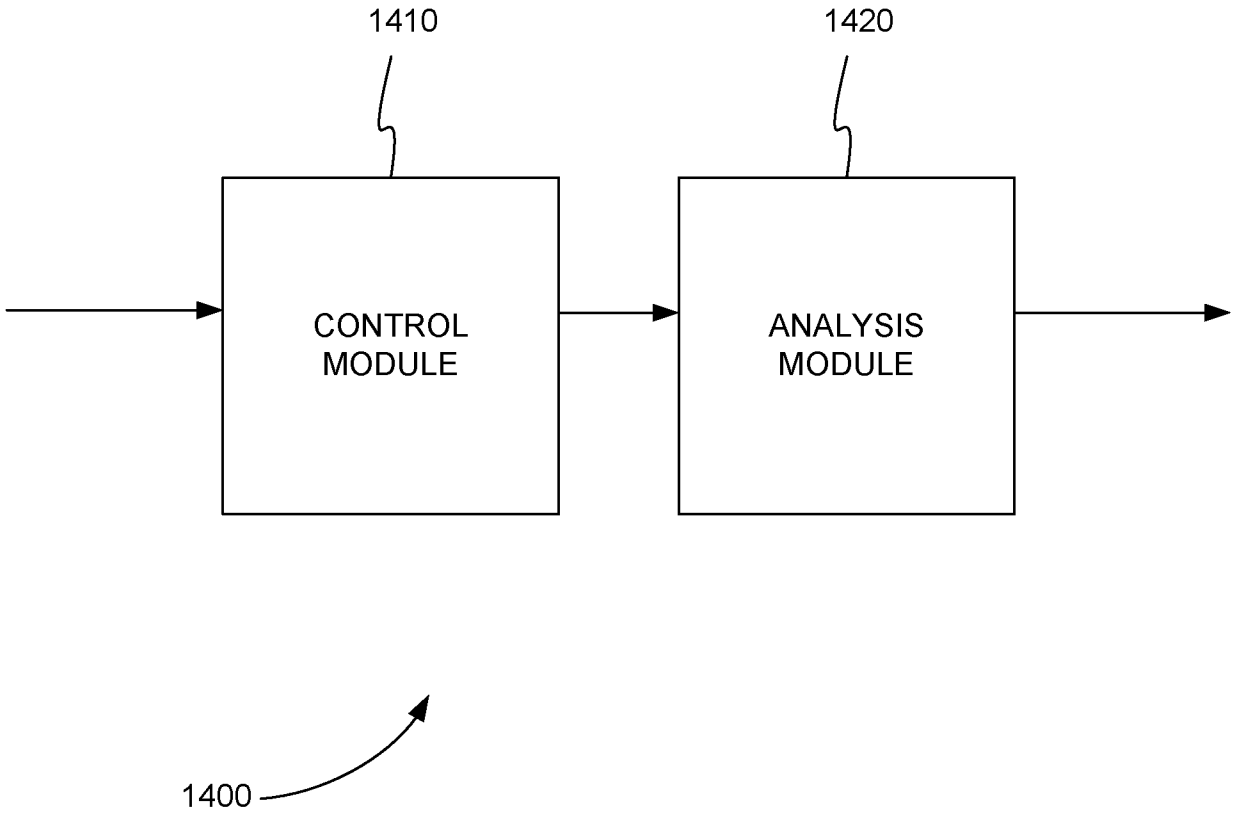
FIG. 14 is an exemplary schematic diagram of a system that includes one or more distinct software modules that perform a method for separating ions measured by a mass analyzer into two or more mass spectra based on charge state using a single electron multiplier ADC detector, in accordance with various embodiments.

FIG. 14 is an exemplary schematic diagram of a system 1400 that includes one or more distinct software modules that perform a method for separating ions measured by a mass analyzer into two or more mass spectra based on charge state using a single electron multiplier ADC detector, in accordance with various embodiments. System 1400 includes control module 1410 and analysis module 1420.

Control module 1410 instructs a mass analyzer of a mass spectrometer to detect a pulse for each ion impacting an electron multiplier ADC detector of the mass analyzer. Each ion impacting the ADC detector is from a plurality of ions that are transmitted to the mass analyzer by the mass spectrometer. The ADC detector produces detection pulses for detected ions with intensities that are proportional to ion charge state.

Analysis module 1420 calculates a peak for each pulse detected using peak finding. Analysis module 1420 calculates an intensity for each peak. Analysis module 1420 compares an intensity of each peak to two or more different predetermined intensity ranges corresponding to two or more different charge state ranges. Analysis module 1420 then stores each peak in one of two or more data sets corresponding to the two or more predetermined intensity ranges based on the comparison using. Finally, analysis module 1420 creates a mass spectrum for each of the two or more data sets by combining peaks in each data set. As a result, two or more mass spectra are produced for ions detected by the mass analyzer based on charge state.

Image-Charge Detector Ion Separation

As described above, in electron multiplier detectors, the number of primary electrons generated depends on the charge state of the incident ions. This property of electron multiplier detectors allows them to separate ions based on charge state. However, electron multiplier detectors are not the only type of detectors that produce an intensity that is proportional to ion charge state. Specifically, image-charge detectors can also produce an intensity that is proportional to ion charge state. In fact, image-charge detectors additionally can produce an intensity that varies linearly with ion charge state.

As a result, in various embodiments, ions are measured and then separated according to charge state using a single image-charge detector. An image-charge detector of a mass analyzer measures the time-varying current or voltage induced on the detector by the nearby oscillations of ions in the mass analyzer. Consequently, the induced transient time-domain signal measured by the image-charge detector includes components from each of the ions oscillating in the mass analyzer.

Figure 15:
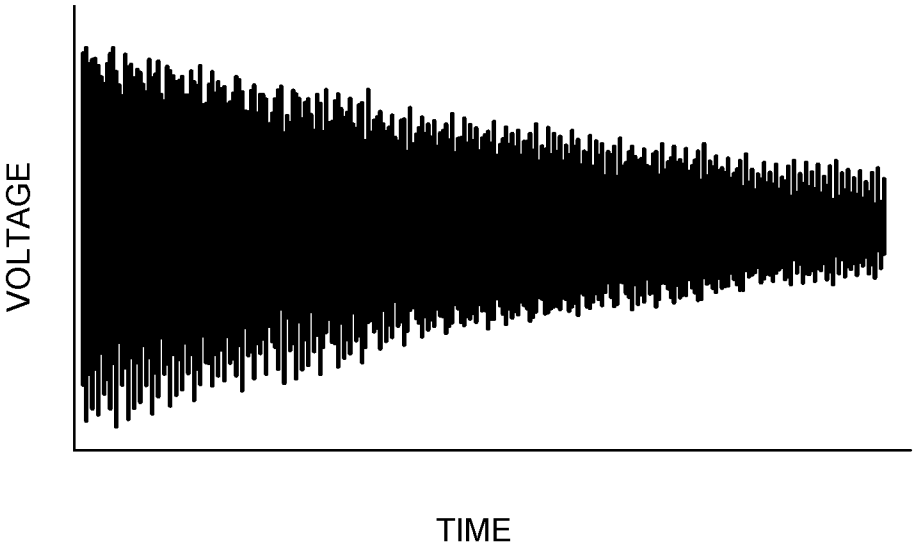
FIG. 15 is a plot of an exemplary transient time-domain signal measured by an image-charge detector that includes components from each of a plurality of ions oscillating in a mass analyzer, in accordance with various embodiments.

FIG. 15 is a plot 1500 of an exemplary transient time-domain signal measured by an image-charge detector that includes components from each of a plurality of ions oscillating in a mass analyzer, in accordance with various embodiments.

In order to decompose the transient time-domain signal measured by an image-charge detector into individual components, the transient time-domain signal is converted to a frequency-domain signal. Conversion methods include, but are not limited to, Fourier transformation or wavelet transformation. Peaks in the frequency-domain signal correspond to individual ions of the plurality of ions oscillating in a mass analyzer. Frequency-domain peaks are converted to m/z peaks using well-known formulas that are dependent on the specific type of mass analyzer in order to produce a mass spectrum.

For image-charge detectors, therefore, the intensity of frequency-domain signals or peaks are proportional to the charge state of the underlying ions. It is, therefore, possible to separate ions with different charge states by sorting frequency-domain peaks with different intensities. This sorting can be performed during or after acquisition.

As with electron multiplier detectors, there is one caveat to this method of sorting measured ion signals. It is dependent upon the oscillation of single ions of a specific m/z and charge state. In other words, if multiple copies of the same ion are oscillating in the mass analyzer at the same time, the measured intensity may not be proportional to the charge state. As a result, in various embodiments, as described below, additional systems and methods are used to limit or prevent multiple ions from being transmitted to the mass analyzer for mass analysis at the same time.

Single Image-Charge Detector Ion Separation System

Figure 16:
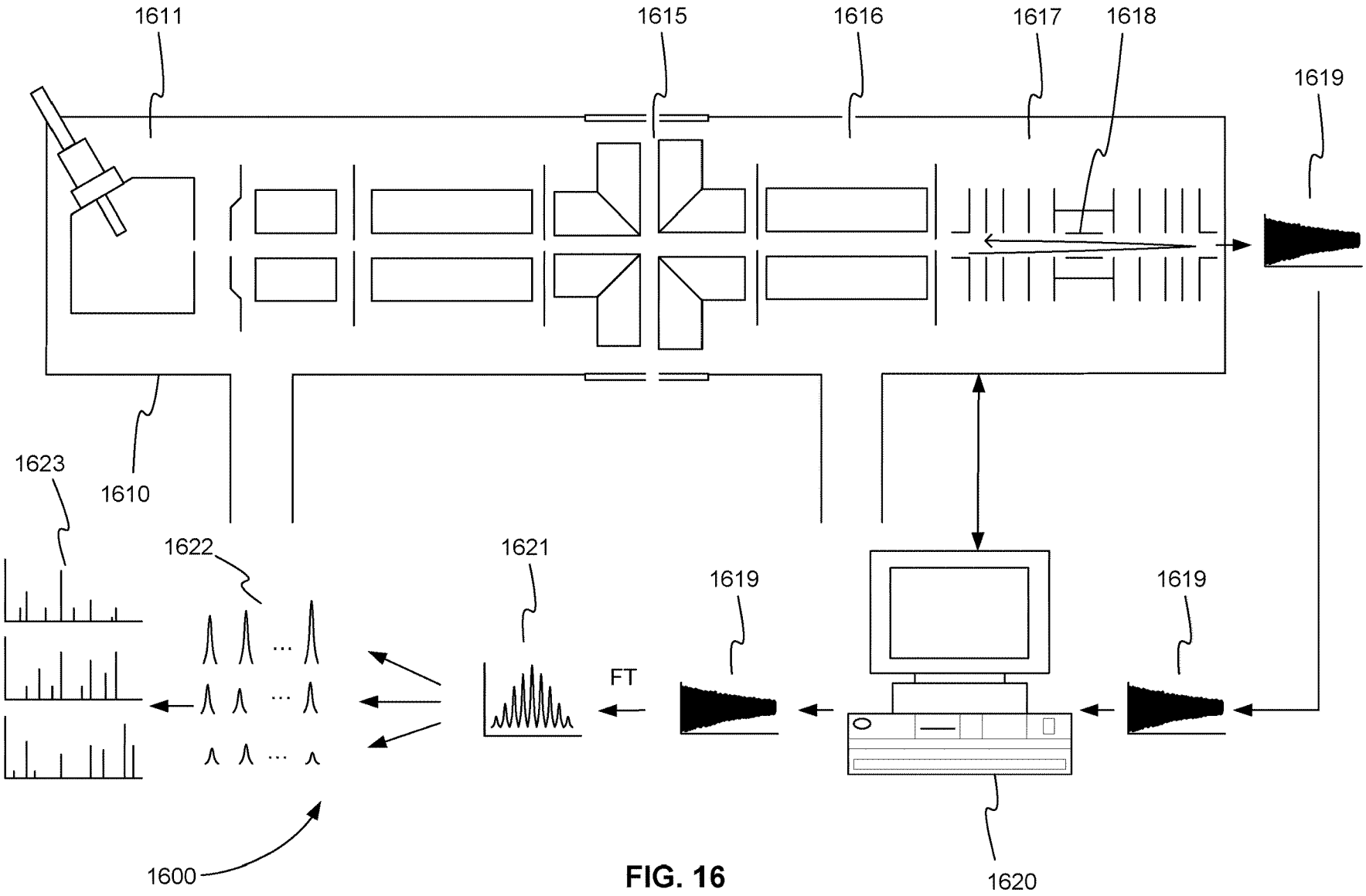
FIG. 16 is an exemplary schematic diagram showing a system for separating ions measured by a mass analyzer into two or more mass spectra based on charge state using a single image-charge detector, in accordance with various embodiments.

FIG. 16 is an exemplary schematic diagram 1600 showing a system for separating ions measured by a mass analyzer into two or more mass spectra based on charge state using a single image-charge detector, in accordance with various embodiments. The system of FIG. 16 includes mass spectrometer 1610 and processor 1620. Mass spectrometer 1610 includes mass analyzer 1617.

Mass analyzer 1617 includes image-charge detector 1618. Image-charge detector 1618 produces oscillating signals or transient time-domain signals for detected ions with amplitudes that are proportional to the ion charge state. Mass analyzer 1617 can be any type of mass analyzer that can detect ions using an image-charge detector including, but not limited to, an electrostatic linear ion trap (ELIT), an FT-ICR, or an orbitrap mass analyzer. Mass analyzer 1617 is shown in FIG. 16 as an ELIT, and image-charge detector 1618 is shown as a pickup electrode of the ELIT.

Processor 1620 instructs mass analyzer 1617 to detect transient time-domain signal 1619 induced on image-charge detector 1618 by oscillations of a plurality of ions in mass analyzer 1617. The plurality of ions is transmitted to mass analyzer 1617 by mass spectrometer 1610. Processor 1620 converts transient time-domain signal 1619 to a plurality of frequency-domain pulses or peaks 1621. Each frequency-domain signal corresponds to an ion of the plurality of ions. Processor 1620 converts transient time-domain signal 1619 to a plurality of frequency-domain peaks 1621 using a Fourier transform, for example.

Processor 1620 compares an intensity of each frequency-domain peak of plurality of frequency-domain peaks 1621 to two or more different predetermined intensity ranges corresponding to two or more different charge state ranges. Processor 1620 stores each frequency-domain peak in one of two or more data sets 1622 corresponding to the two or more predetermined intensity ranges based on the comparison.

Finally, processor 1620 creates a mass spectrum for each of two or more data sets 1622 by combining frequency-domain peaks in each data set and converting the combined frequency-domain peaks in each data set to m/z peaks. Two or more mass spectra 1623 are produced for ions detected by mass analyzer 1617 based on charge state.

In various embodiments, processor 1620 converts transient time-domain signal 1619 to plurality of frequency-domain peaks 1621, compares an intensity of each frequency-domain peak to two or more different predetermined intensity ranges, and stores each frequency-domain peak in one of two or more data sets 1622 during acquisition. In an alternative embodiment, processor 1620 converts transient time-domain signal 1619 to plurality of frequency-domain peaks 1621, compares an intensity of each frequency-domain peak to two or more different predetermined intensity ranges, and stores each frequency-domain peak in one of two or more data sets 1622 after acquisition.

As described above, if multiple copies of the same ion are oscillating in mass analyzer 1617 at the same time, the measured intensity may not be proportional to the charge state. As a result, in various embodiments, mass spectrometer 1610 transmits ions to mass analyzer 1617 so that mass analyzer 1617 only includes a single ion of a specific m/z and charge state at any given time.

In various embodiments, the system of FIG. 16 further includes ion source device 1611. Ion source device 1611 can be an electrospray ion source (ESI) device, for example. Ion source device 1611 is shown as part of mass spectrometer 1610 in FIG. 16 but can be a separate device also.

In addition, mass spectrometer 1610 further includes a dissociation device. The dissociation device can be, but is not limited to, ExD device 1615 or CID device 1616. A dissociation device can be used for top-down protein analysis, for example.

In top-down protein analysis, processor 1620 instructs ion source device 1611 to ionize a protein of a sample, producing a plurality of precursor ions for the protein in an ion beam. Processor 1620 then instructs the dissociation device to dissociate the plurality of precursor ions in the ion beam, producing a plurality of product ions with different charge states in the ion beam.

Processor 1620 instructs mass spectrometer 1610 to transmit the plurality of product ions to mass analyzer 1617 so that the plurality of product ions are the plurality of ions transmitted to mass analyzer 1617 by mass spectrometer 1610, as described above.

In various embodiments, processor 1620 is used to control or provide instructions to ion source device 1611 and mass spectrometer 1610 and to analyze data collected. Processor 1620 controls or provides instructions by, for example, controlling one or more voltage, current, or pressure sources (not shown). Processor 1620 can be a separate device as shown in FIG. 16 or can be a processor or controller of one or more devices of mass spectrometer 1610. Processor 1620 can be, but is not limited to, a controller, a computer, a microprocessor, the computer system of FIG. 1, or any device capable of sending and receiving control signals and data and analyzing data.

Single Image-Charge Detector Ion Separation Method

Figure 17:
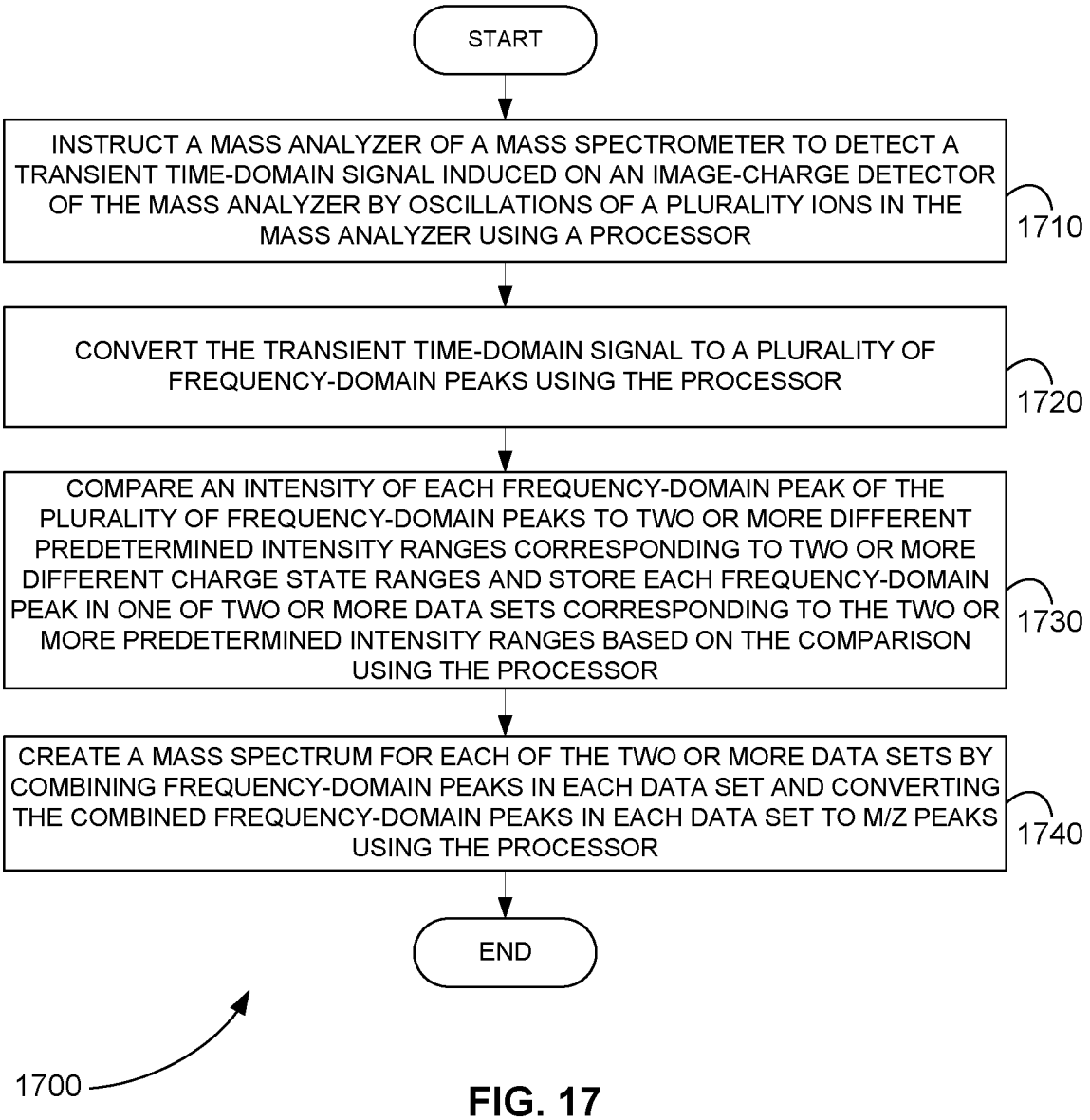
FIG. 17 is a flowchart showing a method for separating ions measured by a mass analyzer into two or more mass spectra based on charge state using a single electron multiplier image-charge detector, in accordance with various embodiments.

FIG. 17 is a flowchart showing a method 1700 for separating ions measured by a mass analyzer into two or more mass spectra based on charge state using a single electron multiplier image-charge detector, in accordance with various embodiments.

In step 1710 of method 1700, a mass analyzer of a mass spectrometer is instructed to detect a transient time-domain signal induced on an image-charge detector of the mass analyzer by oscillations of a plurality of ions in the mass analyzer using a processor. The plurality of ions is transmitted to the mass analyzer by the mass spectrometer.

In step 1720, the transient time-domain signal is converted to a plurality of frequency-domain peaks using the processor. Each frequency-domain peak corresponds to an ion of the plurality of ions.

In step 1730, an intensity of each frequency-domain peak of the plurality of frequency-domain peaks is compared to two or more different predetermined intensity ranges corresponding to two or more different charge state ranges using the processor. In addition, each frequency-domain peak is stored in one of two or more data sets corresponding to the two or more predetermined intensity ranges based on the comparison using the processor.

In step 1740, a mass spectrum is created for each of the two or more data sets by combining frequency-domain peaks in each data set, and the combined frequency-domain peaks in each data set are converted to m/z peaks using the processor. Two or more mass spectra are produced for ions detected by the mass analyzer based on charge state.

Single Image-Charge Detector Ion Separation Computer Program Product

In various embodiments, computer program products include a tangible computer-readable storage medium whose contents include a program with instructions being executed on a processor so as to perform a method for separating ions measured by a mass analyzer into two or more mass spectra based on charge state using a single electron multiplier image-charge detector. This method is performed by a system that includes one or more distinct software modules.

Figure 18:
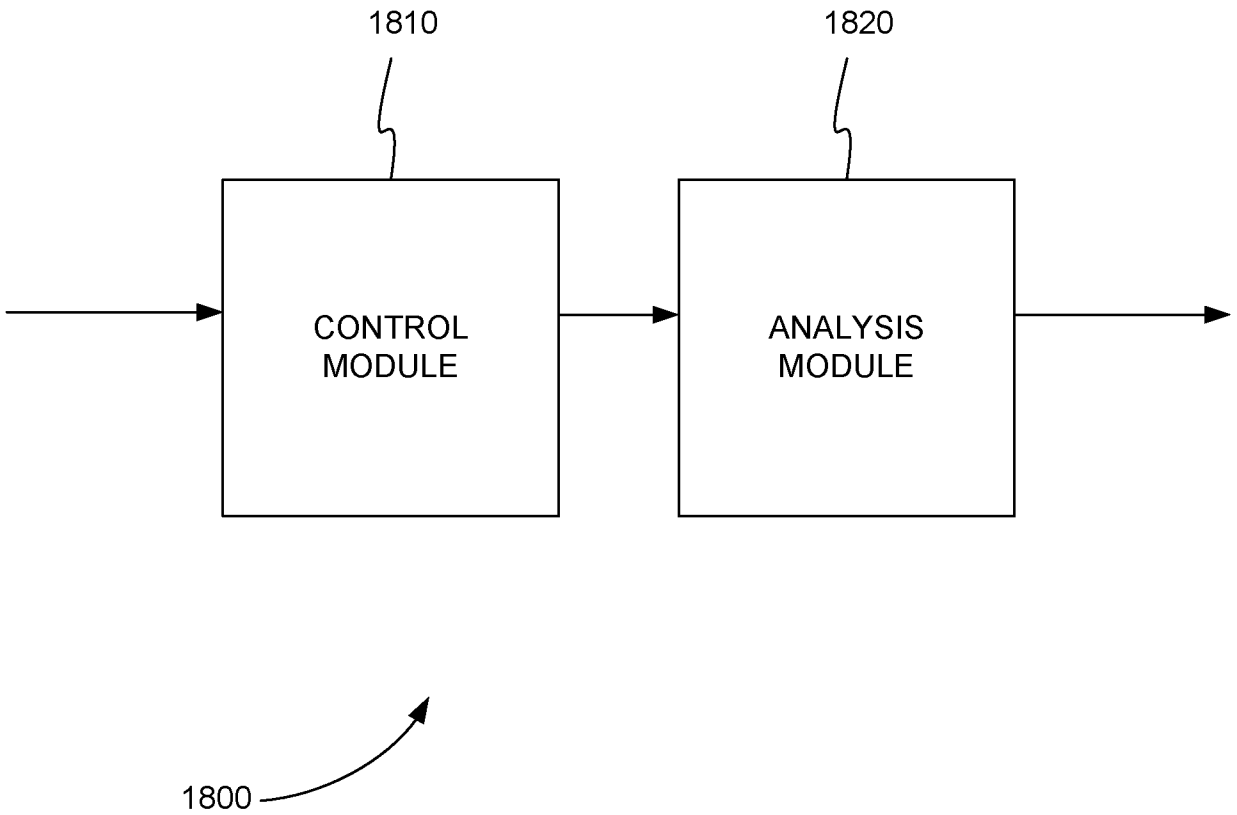
FIG. 18 is an exemplary schematic diagram of a system that includes one or more distinct software modules that perform a method for separating ions measured by a mass analyzer into two or more mass spectra based on charge state using a single electron multiplier image-charge detector, in accordance with various embodiments.

FIG. 18 is an exemplary schematic diagram of a system 1800 that includes one or more distinct software modules that perform a method for separating ions measured by a mass analyzer into two or more mass spectra based on charge state using a single electron multiplier image-charge detector, in accordance with various embodiments. System 1800 includes control module 1810 and analysis module 1820.

Control module 1810 instructs a mass analyzer of a mass spectrometer to detect a transient time-domain signal induced on an image-charge detector of the mass analyzer by oscillations of a plurality of ions in the mass analyzer. The plurality of ions is transmitted to the mass analyzer by the mass spectrometer.

Analysis module 1820 converts the transient time-domain signal to a plurality of frequency-domain peaks. Each frequency-domain peak corresponds to an ion of the plurality of ions. Analysis module 1820 compares an intensity of each frequency-domain peak of the plurality of frequency-domain peaks to two or more different predetermined intensity ranges corresponding to two or more different charge state ranges. Analysis module 1820 stores each frequency-domain peak in one of two or more data sets corresponding to the two or more predetermined intensity ranges based on the comparison. Finally, analysis module 1820 creates a mass spectrum for each of the two or more data sets by combining frequency-domain peaks in each data set and converting the combined frequency-domain peaks in each data set to m/z peaks. Two or more mass spectra are produced for ions detected by the mass analyzer based on charge state.

Multiple ADC Detector Ion Separation

As described above, Chernushevich et al. used multiple TDC detectors to separate ions based on charge state. TDC detectors, however, do not measure intensities of ion signals and, therefore, charge states directly. Also, each TDC detector requires a CFD device to limit intensities measured by the TDC detector. As a result, the use of multiple TDC detectors requires additional processing and hardware to find ranges of intensities and charge states.

In various embodiments, ions are measured and then separated according to charge state using two or more ADC detectors. ADC detectors measure ion intensities directly and do not require a CFD to limit the intensities they can measure.

Multiple ADC Detector Ion Separation System

Figure 19:
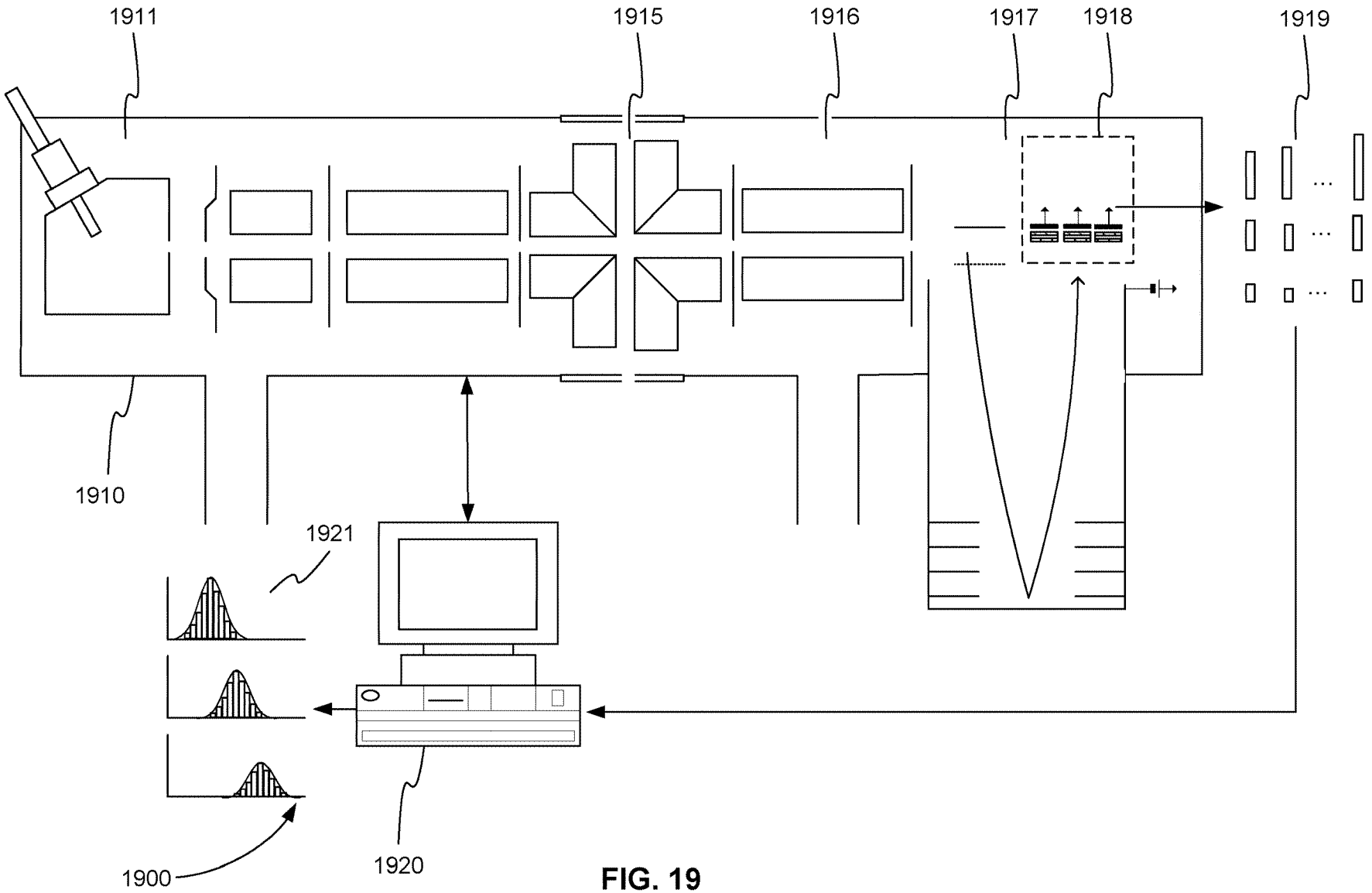
FIG. 19 is an exemplary schematic diagram showing a system for separating ions measured by a mass analyzer into two or more mass spectra based on charge state using multiple electron multiplier ADC detectors, in accordance with various embodiments.

FIG. 19 is an exemplary schematic diagram 1900 showing a system for separating ions measured by a mass analyzer into two or more mass spectra based on charge state using multiple electron multiplier ADC detectors, in accordance with various embodiments. The system of FIG. 19 includes mass spectrometer 1910 and processor 1920. Mass spectrometer 1910 includes mass analyzer 1917.

Mass analyzer 1917 includes two or more electron multiplier ADC detectors 1918. Each detector of two or more ADC detectors 1918 produces detection pulses for detected ions with intensities that are proportional to ion charge state. Each detector of two or more ADC detectors 1918 is adapted to use peak finding to calculate peaks from the detection pulses that are within a different ion intensity range of two or more predetermined intensity ranges. For example, each detector of two or more ADC detectors 1918 is provided with a different gain setting to detect a different ion intensity range of two or more predetermined intensity ranges. The two or more predetermined intensity ranges correspond to two or more different charge state ranges. Mass analyzer 1917 can be any type of mass analyzer that can detect ions using an ADC detector including, but not limited to, a time-of-flight (TOF), an ion trap, or a quadrupole mass analyzer.

Processor 1920 instructs mass analyzer 1917 to simultaneously detect pulses and calculate peaks using each of two or more ADC detectors 1918 as ions from a plurality of ions in the mass analyzer impact two or more ADC detectors 1918. The plurality of ions is transmitted to mass analyzer 1917 by mass spectrometer 1910.

In various embodiments, each of two or more ADC detectors 1918 calculates an intensity and arrival time pair for each peak. As a result, intensity and arrival time pairs 1919 are produced by two or more ADC detectors 1918.

Processor 1920 stores each peak of each detector in a data set corresponding to the detector, producing two or more data sets corresponding to the two or more different charge states.

Again, the terms "store" and "stored" do not mean to imply that all of the processing cannot occur in real-time or that the steps following any "storing" can only occur post-acquisition. In other words, processor 1920 stores each peak in one of two or more data sets and then creates a mass spectrum for each of the two or more data sets all in real-time.

Processor 1920 creates a mass spectrum for each of two or more data sets 1919 by combining peaks in each data set. Two or more mass spectra are produced for ions detected by mass analyzer 1917 based on charge state. In various embodiments, combining peaks in each data set of the two or more data sets comprises combining intensity and arrival time pairs of peaks in each data into a histogram and creating the mass spectrum from the histogram. Mass spectra 1921, for example, are created from the histograms. Note that only one mass peak is shown for each spectrum of mass spectra 1921. However, each spectrum can include one or more mass peaks.

As shown in FIG. 19, each of two or more ADC detectors 1918 is a separate detector and ADC pair.

In various alternative embodiments, two or more ADC detectors 1918 can be realized using a single electron-multiplier detector and multiple ADC devices. In other words, two or more ADC detectors 1918 include a single electron multiplier detector (not shown) connected to two or more ADC devices (not shown). The two or more ADC devices digitize the same output of the single electron multiplier detector. Each ADC device of the two or more ADC devices is adapted to use peak finding to calculate peaks from the detection pulses that are within a different ion intensity range of two or more predetermined intensity ranges.

As a result intensity and arrival time pairs 1919 are produced by the two or more ADC devices. Processor 1920 stores each peak of each ADC device in a data set corresponding to the detector, producing two or more data sets corresponding to the two or more different charge states.

In various embodiments, the two or more different predetermined intensity ranges include at least two ranges that are overlapping. In various alternative embodiments, processor 1920 further combines data sets corresponding to the at least two ranges to produce one or more data sets corresponding to one or more non-overlapping intensity ranges.

In various embodiments, each detector of two or more ADC detectors 1918 is adapted to use peak finding to calculate peaks using a processor (not shown) of each detector. Similarly, each ADC device of the two or more ADC devices is adapted to use peak finding to calculate peaks using a processor (not shown).

In various alternative embodiments, each detector of two or more ADC detectors 1918 is adapted to use peak finding to calculate peaks using processor 1920. Similarly, each ADC device of the two or more ADC devices is adapted to use peak finding to calculate peaks using a processor 1920.

Figure 24:
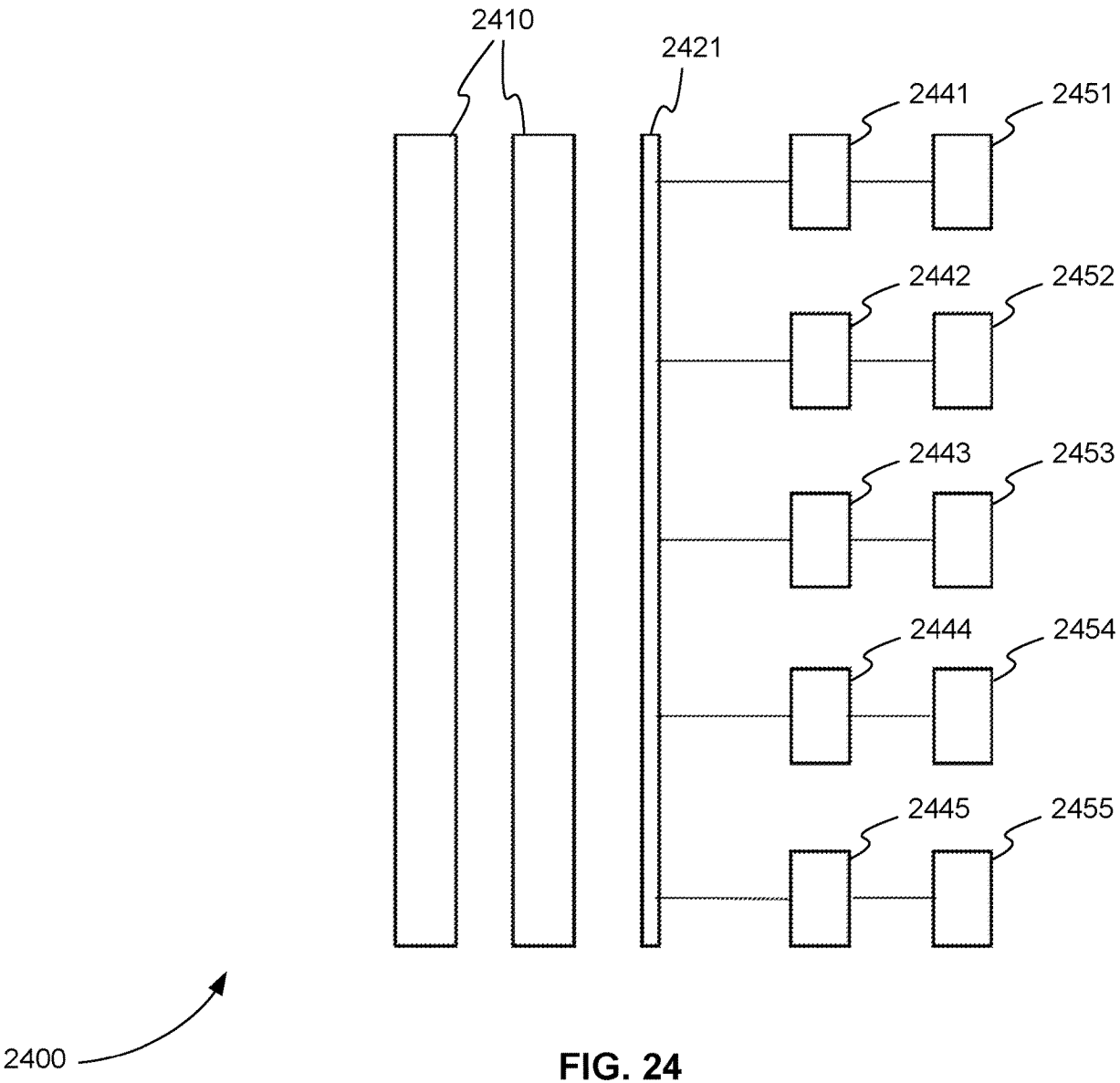
FIG. 24 is a side view of an exemplary TOF ion detection system that includes a single electron multiplier detector connected to five ADC devices, upon which embodiments of the present teachings may be implemented.

FIG. 24 is a side view 2400 of an exemplary TOF ion detection system that includes a single electron multiplier detector connected to five ADC devices, upon which embodiments of the present teachings may be implemented. In this ion detection system, five ADC devices 2451, 2452, 2453, 2454, and 2455 are connected to single detector output or anode 2421. In comparison to the segmented anode of FIG. 23, single anode or electrode 2421 of FIG. 24 does not improve resolution. However, there is still the benefit of an improved dynamic range, which is achieved by configuring the five different ADC devices to digitize the same signal amplified to a different gain.

Anode 2421 collects multiplied electrons produced by MCPs 2410. In various embodiments, five ADC devices 2451, 2452, 2453, 2454, and 2455 are connected to single detector output or anode 2421 through preamplifiers 2441, 2442, 2443, 2444, and 2445, respectively.

In various embodiments, and as described above, the TOF ion detection system of FIG. 24, can be used for data subtraction. This is because each ADC device in this embodiment is digitizing essentially the same signal amplified to a different level (or digitizing it with different ADC threshold).

Figure 20:
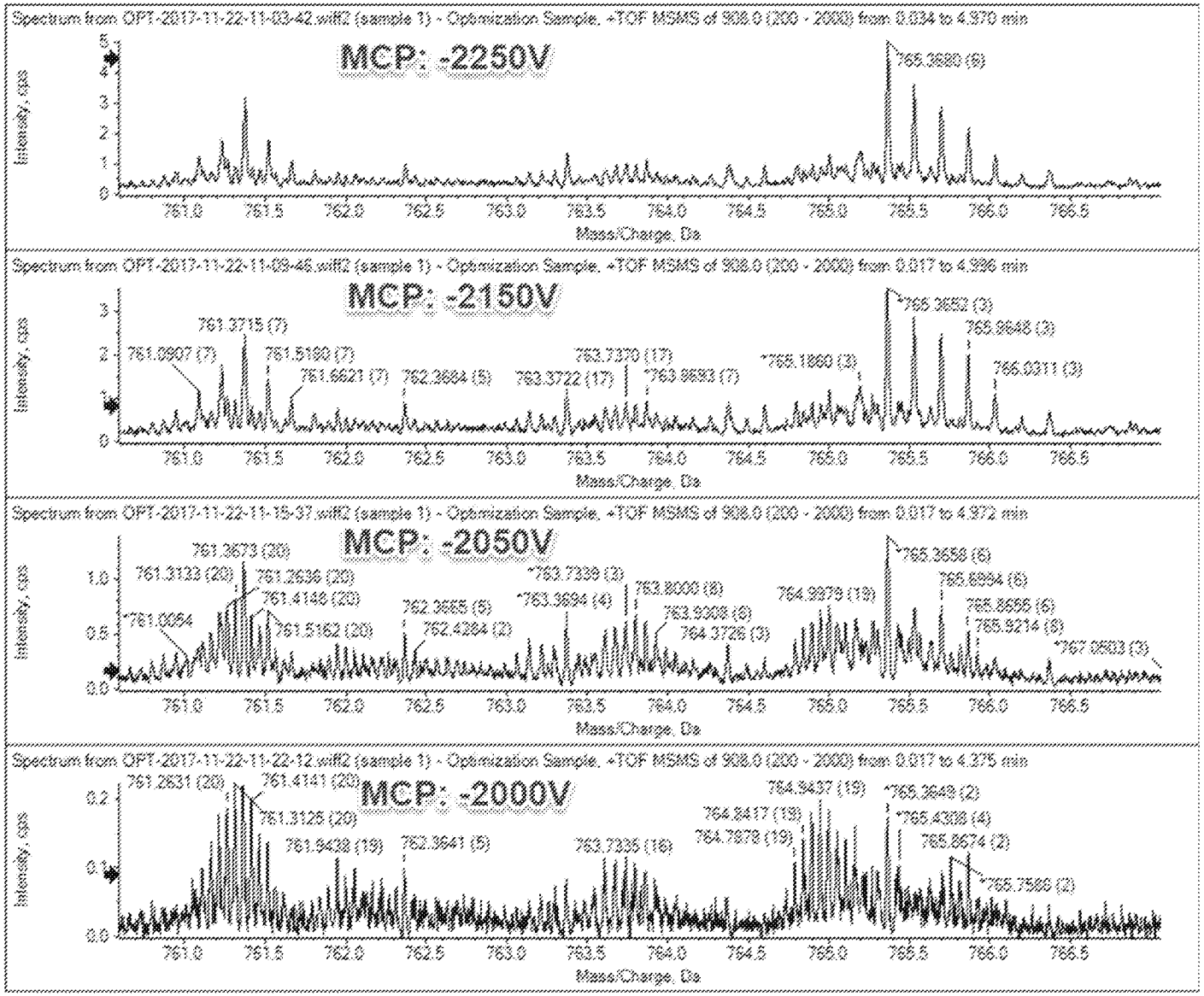
FIG. 20 is a series of mass spectra produced by a system for separating ions measured by a mass analyzer into two or more mass spectra based on charge state using multiple ADC detectors, in accordance with various embodiments.

FIG. 20 is a series 2000 of mass spectra produced by a system for separating ions measured by a mass analyzer into two or more mass spectra based on charge state using multiple ADC detectors settings, in accordance with various embodiments. In this case, different gain voltages are applied to the multichannel plates of the multiple ADC detectors. With each decrease in detector gain (increasing negative voltage), fewer ions with lower charge states are obtained.

The mass spectra in FIG. 20 measured with a lower voltage gain (higher detector gain) also include the ions of the mass spectra measured with a higher voltage gain (lower detector gain). If the multiple ADC's are digitizing the same detector output (as shown in FIG. 24), the mass spectra measured with a lower detector gain can be subtracted from the mass spectra measured with a higher detector gain to further separate the ions with higher charge states on the mass spectra measured with a lower voltage. In other words, further processing of the mass spectra of FIG. 20 can produce banded mass spectra like the mass spectra shown in plot 820 of FIG. 8.

Returning to FIG. 19, as described above, the measured intensity of a detected pulse is proportional to the charge state only for single ion arrivals at each of two or more ADC detectors 1918. In other words, if multiple ions arrive at a detector of two or more ADC detectors 1918 at the same time, the measured intensity may not be proportional to the charge state. As a result, in various embodiments, mass spectrometer 1910 transmits ions to mass analyzer 1917 so that each of two or more ADC detectors 1918 only receives a single ion impact at any given time.

In various embodiments, the system of FIG. 19 further includes ion source device 1911. Ion source device 1911 can be an electrospray ion source (ESI) device, for example. Ion source device 1911 is shown as part of mass spectrometer 1910 in FIG. 19 but can be a separate device also.

In addition, mass spectrometer 1910 further includes a dissociation device. The dissociation device can be, but is not limited to, ExD device 1915 or CID device 1916. A dissociation device can be used for top-down protein analysis, for example.

In top-down protein analysis, processor 1920 instructs ion source device 1911 to ionize a protein of a sample, producing a plurality of precursor ions for the protein in an ion beam. Processor 1920 then instructs the dissociation device to dissociate the plurality of precursor ions in the ion beam, producing a plurality of product ions with different charge states in the ion beam.

Processor 1920 instructs mass spectrometer 1910 to transmit the plurality of product ions to mass analyzer 1917 so that the plurality of product ions are the plurality of ions transmitted to mass analyzer 1917 by mass spectrometer 1910 as described above.

In various embodiments, processor 1920 is used to control or provide instructions to ion source device 1911 and mass spectrometer 1910 and to analyze data collected. Processor 1920 controls or provides instructions by, for example, controlling one or more voltage, current, or pressure sources (not shown). Processor 1920 can be a separate device as shown in FIG. 19 or can be a processor or controller of one or more devices of mass spectrometer 1910. Processor 1920 can be, but is not limited to, a controller, a computer, a microprocessor, the computer system of FIG. 1, or any device capable of sending and receiving control signals and data and analyzing data.

Multiple ADC Detector Ion Separation Method

Figure 21:
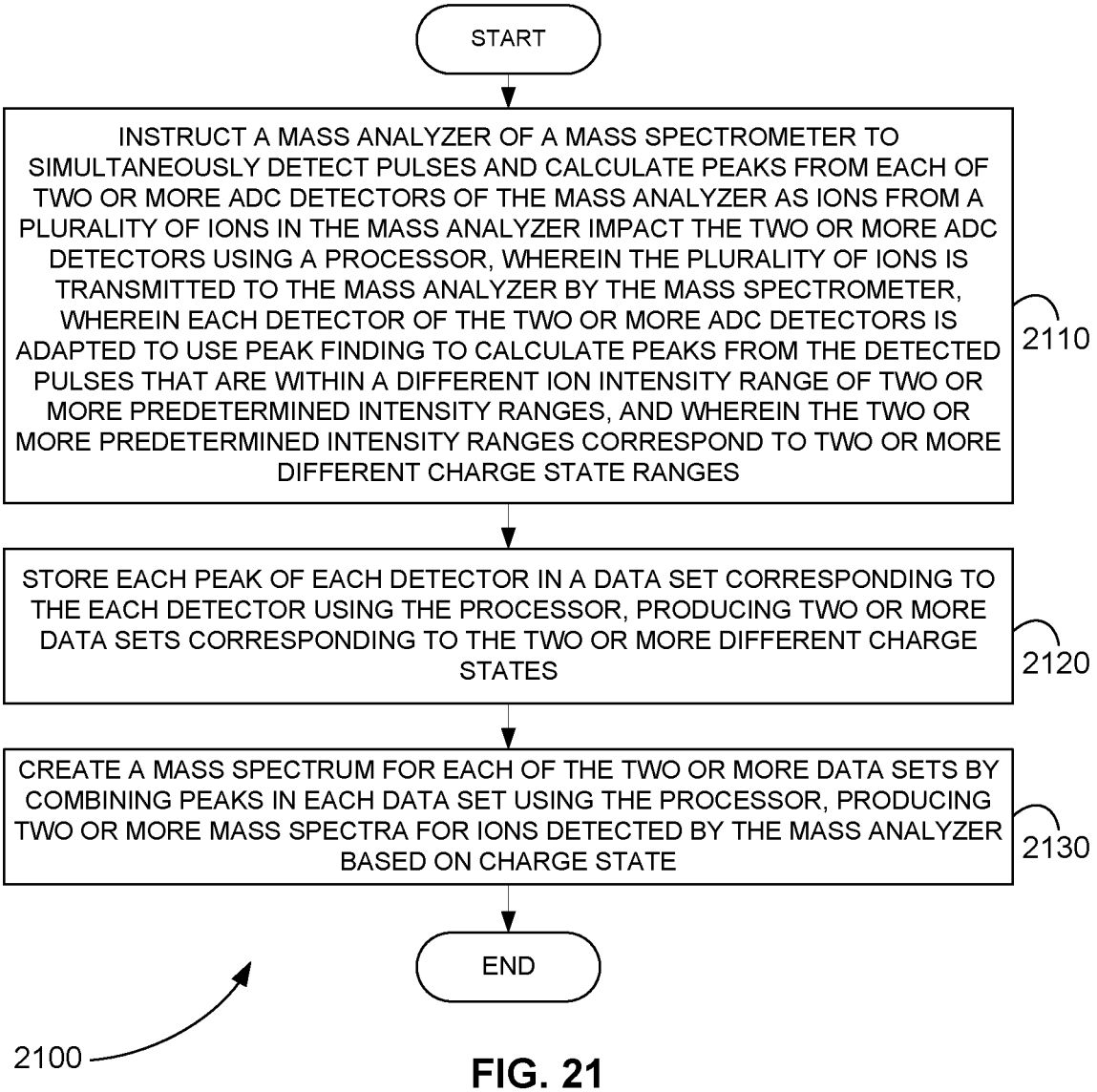
FIG. 21 is a flowchart showing a method for separating ions measured by a mass analyzer into two or more mass spectra based on charge state using multiple electron multiplier ADC detectors, in accordance with various embodiments.

FIG. 21 is a flowchart showing a method 2100 for separating ions measured by a mass analyzer into two or more mass spectra based on charge state using multiple electron multiplier ADC detectors, in accordance with various embodiments.

In step 2110 of method 2100, a mass analyzer of a mass spectrometer is instructed to simultaneously detect pulses and calculate peaks using each of two or more ADC detectors of the mass analyzer as ions from a plurality of ions in the mass analyzer impact the two or more ADC detectors using a processor. The plurality of ions are transmitted to the mass analyzer by the mass spectrometer. Each detector of the two or more ADC detectors is adapted to use peak finding to calculate peaks from the detected pulses that are within a different ion intensity range of two or more predetermined intensity ranges. The two or more predetermined intensity ranges correspond to two or more different charge state ranges.

In step 2120, each peak of each detector is stored in a data set corresponding to the detector using the processor, producing two or more data sets corresponding to the two or more different charge states.

In step 2130 a mass spectrum is created for each of the two or more data sets by combining peaks in each data set using the processor, producing two or more mass spectra for ions detected by the mass analyzer based on charge state.

Multiple ADC Detector Ion Separation Computer Program Product

In various embodiments, computer program products include a tangible computer-readable storage medium whose contents include a program with instructions being executed on a processor so as to perform a method for separating ions measured by a mass analyzer into two or more mass spectra based on charge state using a single electron multiplier ADC detector. This method is performed by a system that includes one or more distinct software modules.

Figure 22:
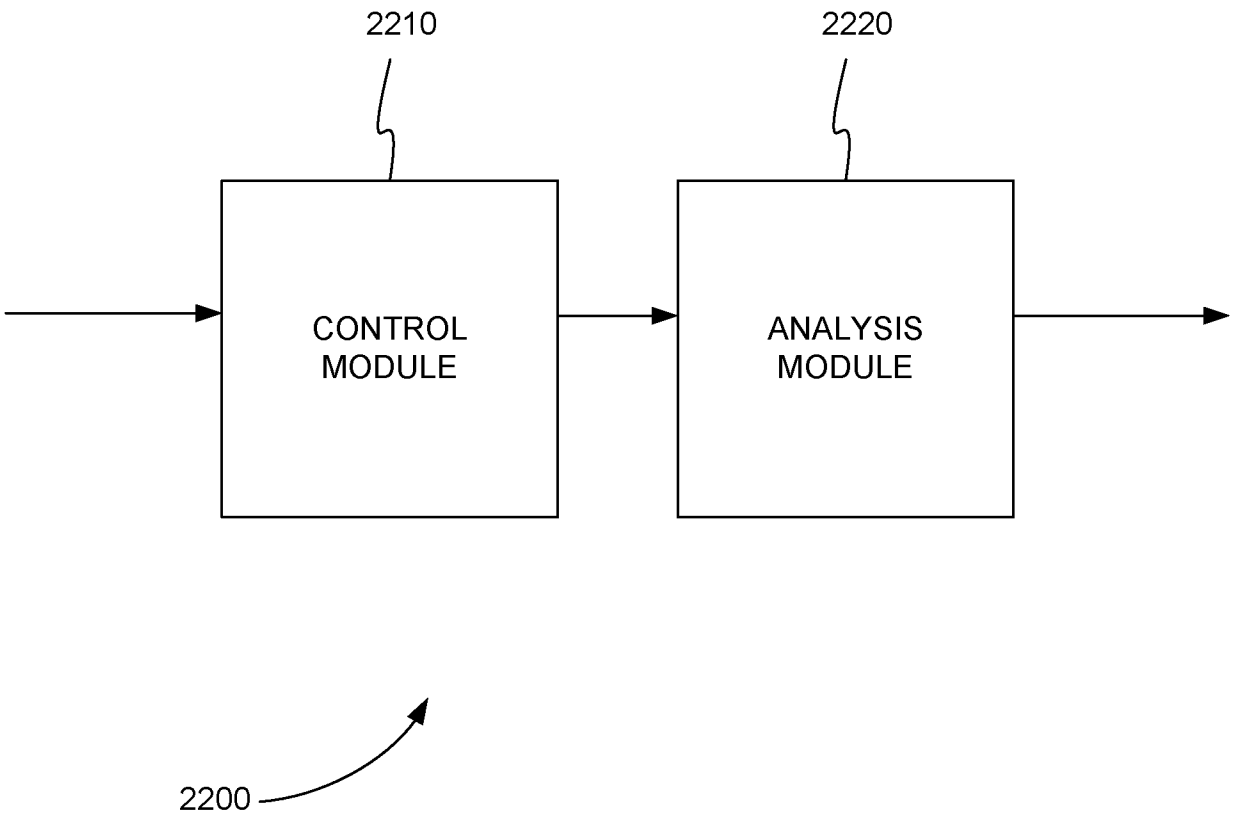
FIG. 22 is an exemplary schematic diagram of a system that includes one or more distinct software modules that perform a method for separating ions measured by a mass analyzer into two or more mass spectra based on charge state using a single electron multiplier ADC detector, in accordance with various embodiments.

FIG. 22 is an exemplary schematic diagram of a system 2200 that includes one or more distinct software modules that perform a method for separating ions measured by a mass analyzer into two or more mass spectra based on charge state using a single electron multiplier ADC detector, in accordance with various embodiments. System 2200 includes control module 2210 and analysis module 2220.

Control module 2210 instructs a mass analyzer of a mass spectrometer to simultaneously detect pulses and calculate peaks using each of two or more ADC detectors of the mass analyzer as ions from a plurality of ions in the mass analyzer impact the two or more ADC detectors. The plurality of ions is transmitted to the mass analyzer by the mass spectrometer. Each detector of the two or more ADC detectors is adapted to use peak finding to calculate peaks from the detected pulses that are within a different ion intensity range of two or more predetermined intensity ranges. The two or more predetermined intensity ranges correspond to two or more different charge state ranges.

Analysis module 2220 stores each peak of each detector in a data set corresponding to each detector, producing two or more data sets corresponding to the two or more different charge states. Analysis module 2220 creates a mass spectrum for each of the two or more data sets by combining peaks in each data set, producing two or more mass spectra for ions detected by the mass analyzer based on charge state.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for separating ions measured by a mass analyzer into two or more mass spectra based on charge state using a single electron multiplier analog-to-digital conversion (ADC) detector, comprising:

a mass spectrometer that includes a mass analyzer, wherein the mass analyzer includes an electron multiplier ADC detector that produces detection pulses for detected ions with intensities that are proportional to ion charge state; and a processor that instructs the mass analyzer to detect a pulse for each ion impacting the ADC detector from a plurality of ions that are transmitted to the mass analyzer by the mass spectrometer, calculates a peak for each pulse detected using peak finding, calculates an intensity for each peak, compares the intensity of each peak to two or more different predetermined intensity ranges corresponding to two or more different charge state ranges and stores each peak in one of two or more data sets corresponding to the two or more predetermined intensity ranges based on the comparison, and creates a mass spectrum for each of the two or more data sets by combining peaks in each data set of the two or more data sets, producing two or more mass spectra for ions detected by the mass analyzer based on charge state.

2. The system of claim 1, wherein the processor further calculates an arrival time for each peak and wherein the intensity of each peak and the arrival time of each peak form an intensity and arrival time pair for each peak.

3. The system of claim 2, wherein combining peaks in each data set of the two or more data sets comprises combining intensity and arrival time pairs of peaks in each data into a histogram and creating the mass spectrum from the histogram.

4. The system of claim 1, wherein the processor further stores each peak in one or more other data sets of the two or more data sets.

5. The system of claim 1, wherein the two or more different predetermined intensity ranges include at least two ranges that are overlapping.

6. The system of claim 5, wherein the processor further combines data sets corresponding to the at least two ranges to produce one or more data sets corresponding to one or more non-overlapping intensity ranges.

7. The system of claim 1, wherein the processor compares the intensity of each peak to two or more different predetermined intensity ranges corresponding to two or more different charge state ranges and stores each peak in one of two or more data sets during acquisition.

8. The system of claim 1, wherein the processor compares the intensity of each peak to two or more different predetermined intensity ranges corresponding to two or more different charge state ranges and stores each peak in one of two or more data sets after acquisition.

9. The system of claim 1, wherein the mass spectrometer transmits ions to the mass analyzer so that the ADC detector only receives a single ion impact at any given time.

10. The system of claim 1, further including an ion source device, wherein the mass spectrometer further includes a dissociation device and wherein the processor further provides a top-down protein analysis by instructing the ion source device to ionize a protein of a sample, producing a plurality of precursor ions for the protein in an ion beam, and instructing the dissociation device to dissociate the plurality of precursor ions in the ion beam, producing a plurality of product ions with different charge states in the ion beam, and instructing the mass spectrometer to transmit the plurality of product ions to the mass analyzer so that the plurality of product ions are the plurality of ions transmitted to the mass analyzer by the mass spectrometer.

11. The system of claim 1, wherein the ADC detector comprises a multi-channel digitizer and the processor instructs the mass analyzer to detect a pulse for each ion impacting the ADC detector from each digitizer of the multi-channel digitizer.

12. The system of claim 11, wherein each digitizer of the multi-channel digitizer is adapted to digitize pulses within a different predetermined intensity range of the two or more different predetermined intensity ranges.

13. A method for separating ions measured by a mass analyzer into two or more mass spectra based on charge state using a single electron multiplier analog-to-digital conversion (ADC) detector, comprising:

instructing a mass analyzer of a mass spectrometer to detect a pulse for each ion impacting an electron multiplier ADC detector of the mass analyzer using a processor, wherein each ion impacting the ADC detector is from a plurality of ions that are transmitted to the mass analyzer by the mass spectrometer and wherein the ADC detector produces detection pulses for detected ions with intensities that are proportional to ion charge state;

calculating a peak for each pulse detected using peak finding using the processor;

calculating an intensity for each peak using the processor;

comparing the intensity of each peak to two or more different predetermined intensity ranges corresponding to two or more different charge state ranges and storing each peak in one of two or more data sets corresponding to the two or more predetermined intensity ranges based on the comparison using the processor; and creating a mass spectrum for each of the two or more data sets by combining peaks in each data set using the processor, producing two or more mass spectra for ions detected by the mass analyzer based on charge state.

14. A computer program product, comprising a non-transitory and tangible computer-readable storage medium whose contents include a program with instructions being executed on a processor so as to perform a method for separating ions measured by a mass analyzer into two or more mass spectra based on charge state using a single electron multiplier analog-to-digital conversion (ADC) detector, the method comprising:

providing a system, wherein the system comprises one or more distinct software modules, and wherein the distinct software modules comprise a control module and an analysis module;

instructing a mass analyzer of a mass spectrometer to detect a pulse for each ion impacting an electron multiplier ADC detector of the mass analyzer using the control module, wherein each ion impacting the ADC detector is from a plurality of ions that are transmitted to the mass analyzer by the mass spectrometer and wherein the ADC detector produces detection pulses for detected ions with intensities that are proportional to ion charge state;

calculating a peak for each pulse detected using peak finding using the analysis module;

calculating an intensity for each peak using the analysis module;

comparing the intensity of each peak to two or more different predetermined intensity ranges corresponding to two or more different charge state ranges and storing each peak in one of two or more data sets corresponding to the two or more predetermined intensity ranges based on the comparison using the analysis module; and creating a mass spectrum for each of the two or more data sets by combining peaks in each data set using the analysis module, producing two or more mass spectra for ions detected by the mass analyzer based on charge state.

* * * * *